US008814491B2

(12) United States Patent
Demers

(10) Patent No.: US 8,814,491 B2
(45) Date of Patent: Aug. 26, 2014

(54) METHOD AND SYSTEM FOR MAIL ITEM TURNOVER

(75) Inventor: Michelle Demers, New Hill, NC (US)

(73) Assignee: Bell and Howell, LLC., Durham, NC (US)

( * ) Notice: Subject to any disclaimer, the term of this patent is extended or adjusted under 35 U.S.C. 154(b) by 18 days.

(21) Appl. No.: 13/565,522

(22) Filed: Aug. 2, 2012

(65) Prior Publication Data

US 2014/0034450 A1 Feb. 6, 2014

(51) Int. Cl.
*B65G 57/00* (2006.01)

(52) U.S. Cl.
USPC ..... 414/758; 414/759; 414/764; 198/404; 271/186

(58) Field of Classification Search
USPC ..... 271/65, 186; 198/404; 414/758, 759, 414/761, 764, 765, 767
See application file for complete search history.

(56) References Cited

U.S. PATENT DOCUMENTS 3,744,614 A * 7/1973 Shooter et al. ..... 198/404
4,354,788 A * 10/1982 Giusti ..... 414/791.3
4,798,278 A * 1/1989 Cornacchia ..... 198/399
5,201,399 A * 4/1993 Dietrich ..... 198/409
5,709,484 A * 1/1998 Dorner ..... 400/188
5,771,058 A * 6/1998 Kobayashi ..... 347/218
5,927,713 A * 7/1999 Driscoll et al. ..... 271/298
5,971,695 A * 10/1999 Batzer et al. ..... 414/765
6,279,901 B1 * 8/2001 Fulmer ..... 271/272
6,286,828 B1 * 9/2001 Adema ..... 271/186
6,299,405 B1 * 10/2001 Sterken et al. ..... 414/758
6,793,454 B2 * 9/2004 Brizzi ..... 414/767
7,513,287 B2 * 4/2009 Huber ..... 156/580
7,520,503 B2 * 4/2009 Sussmeier et al. ..... 271/186
2008/0048385 A1 2/2008 Sussmeier et al.

* cited by examiner

*Primary Examiner* — Douglas Hess
(74) *Attorney, Agent, or Firm* — McDermott Will & Emery LLP

(57) ABSTRACT

The present application relates to techniques and equipment for transporting and inverting material, such as a mail item, and exchanging the lead and trail edge of the material along a transport feed path. The equipment conveys material to a holding mechanism that rotates to a suitable angle to the transport feed path and within the plane of the flat material. The direction of the material is reversed while contained in the holding mechanism. The holding mechanism is rotated to turning over the material, e.g., face-up to face-down, and exchanges the lead and trail edges with respect to the feed path.

22 Claims, 18 Drawing Sheets

OPERATOR SIDE VIEW 10

SERVICE SIDE VIEW 20

OPERATOR SIDE VIEW 10

OPERATOR SIDE VIEW 10

OPERATOR SIDE VIEW 10

OPERATOR SIDE VIEW 10

OPERATOR SIDE VIEW 10

OPERATOR SIDE VIEW 10

OPERATOR SIDE VIEW 10

METHOD AND SYSTEM FOR MAIL ITEM TURNOVER

TECHNICAL FIELD

The present subject matter relates to techniques and equipment for inverting a mail item processed on document processing equipment, such as an inserter. A turnover apparatus, associated with the document processing equipment, enables the inverting of a mail item such that the mail item is reoriented from face-down to face-up, and its leading edge and trailing edge are exchanged with respect to the feed path.

BACKGROUND

Turnover twist modules wherein sheets of material are directed linearly along a spiral path typically affected by a series of twisted belts or chords. While such twist modules retain the respective leading and trailing edge position of the sheet material, such modules require a lengthy axial path to change the face-up/face-down orientation of the sheet material. Furthermore, twist modules are less reliable when handling stacked collations inasmuch as the stacked sheets tend to skew as they follow the spiral path. Belt or cord turnover twist modules are prone to mark or damage mail items particularly thick mail items. Moreover, such twist modules are not reconfigurable to handle straight runs wherein sheet material inversion is not required. Consequently, another module must be introduced in place of the twist module to reconfigure the sheet material handling equipment. Turnover modules that flip the mail item side for side result in the flap hinge line changing sides. This requires significant modifications to the downstream processing and printing systems.

Hence a need exists for an improved apparatus for transporting and overturning/inverting material, including a mail item, such that the leading and trailing edges of the mail item are exchanged relative to the conveyance feed path.

SUMMARY

The teachings herein alleviate one or more of the above noted problems with a method and apparatus for conveying and inverting material, such as a mail item, wherein the material orientation is changed from face-down to face-up and the lead and trail edges of the material are exchanged.

In certain examples, an apparatus for inverting a mail item having a leading and trailing end is provided. The apparatus includes a rotatable cage assembly having an input guide section for receiving the mail item from an upstream direction of feeder path by the leading edge of the mail item. The rotatable cage is configured to rotate about an axis of rotation; and invert the mail item during rotation of the rotatable cage about the axis of rotation. A bi-directional drive mechanism conveys the mail item while it is contained in the rotatable cage assembly in accordance with a variable motion profile. The drive mechanism is configured to convey the mail item with its leading end forward in a first direction away from the input guide section of the cage assembly; and convey the mail item with its trailing edge forward in a second direction towards the input guide section during rotation of the rotatable cage about the axis of rotation such that the inverted mail item exits the rotatable cage in a direction towards a downstream direction of the feeder path.

In yet another example, a method of inverting a mail item is provided. The method includes the steps of receiving a mail item from an upstream direction of a feeder path at an input guide section of a rotatable cage assembly. A leading edge of the mail item is detected as it enters the rotatable cage assembly. A first forward motion of the mail item is decelerated a upon detection of the leading edge of the mail item within the rotatable cage. The cage assembly is rotated about an axis of rotation while the mail item is contained within the case assembly. The mail item is conveyed with its trailing edge forward in a second direction towards the input guide section during rotation of the rotatable cage about the axis of rotation such that the inverted mail item exits the rotatable cage in a direction towards a downstream direction of the feeder path. The rotation of the cage assembly and conveyance of the mail item within the cage assembly are independently controlled and coordinated by a variable motion profile.

In some of the examples, the apparatus includes bi-directional conveyance and optionally bi-directional inversion. The material remains in a flat orientation throughout the rotational sequence. Materials of varying thickness and stiffness can be accommodated. The material can reverse directions and turn over concurrently. The motion profile of the cage/holding mechanism and of the conveyance can be altered to advance or draw back the material during the turnover process. The material can reverse directions in a continuous deceleration without stopping or starting thereby minimizing inertial effects of the material.

In certain examples, the apparatus includes a conveyance drive mechanism to move the material along the feed path and a cage/holding mechanism and torque drive to rotate the cage about an axis perpendicular or at some angle to the conveyance feed path and within the plane of the flat material. The conveyance mechanism receives the material into the cage/holding mechanism from an upstream module and reverses the direction of the material while contained in the cage. In coordination, the cage is rotated 180 degrees thereby turning over the material, face-down to face-up, and exchanging the lead and trail edges with respect to the feed path (i.e., flipping the material end for end). The conveyance mechanism completes reversal and ejects the material to a downstream module.

In certain examples, the mail item remains in a flat orientation throughout the spatial move. Moreover, mail items of varying thickness and stiffness can be accommodated. In other examples, the mail item can reverse directions and turn over concurrently. The variable motion profile for the cage/holding mechanism and for the conveyance servos operate independently and in a coordinated motion. The conveyance servo motion profile can run the conveyance forward or backward. The conveyance system can be coordinated to draw back the material so that the conveyance system belts will damp any residual motion caused by the completion of the turnover cycle. The mail item can reverse directions in a continuous deceleration without stopping or starting thereby minimizing inertial effects of the material. In certain examples, the axis of rotation is perpendicular to feeder/conveyance path. In other examples, the turnover cycle makes the trailing edge of the material become the leading edge.

The advantages and novel features are set forth in part in the description which follows, and in part will become apparent to those skilled in the art upon examination of the following and the accompanying drawings or may be learned by production or operation of the examples. The advantages of the present teachings may be realized and attained by practice or use of the methodologies, instrumentalities and combinations described herein.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

Figure 1:
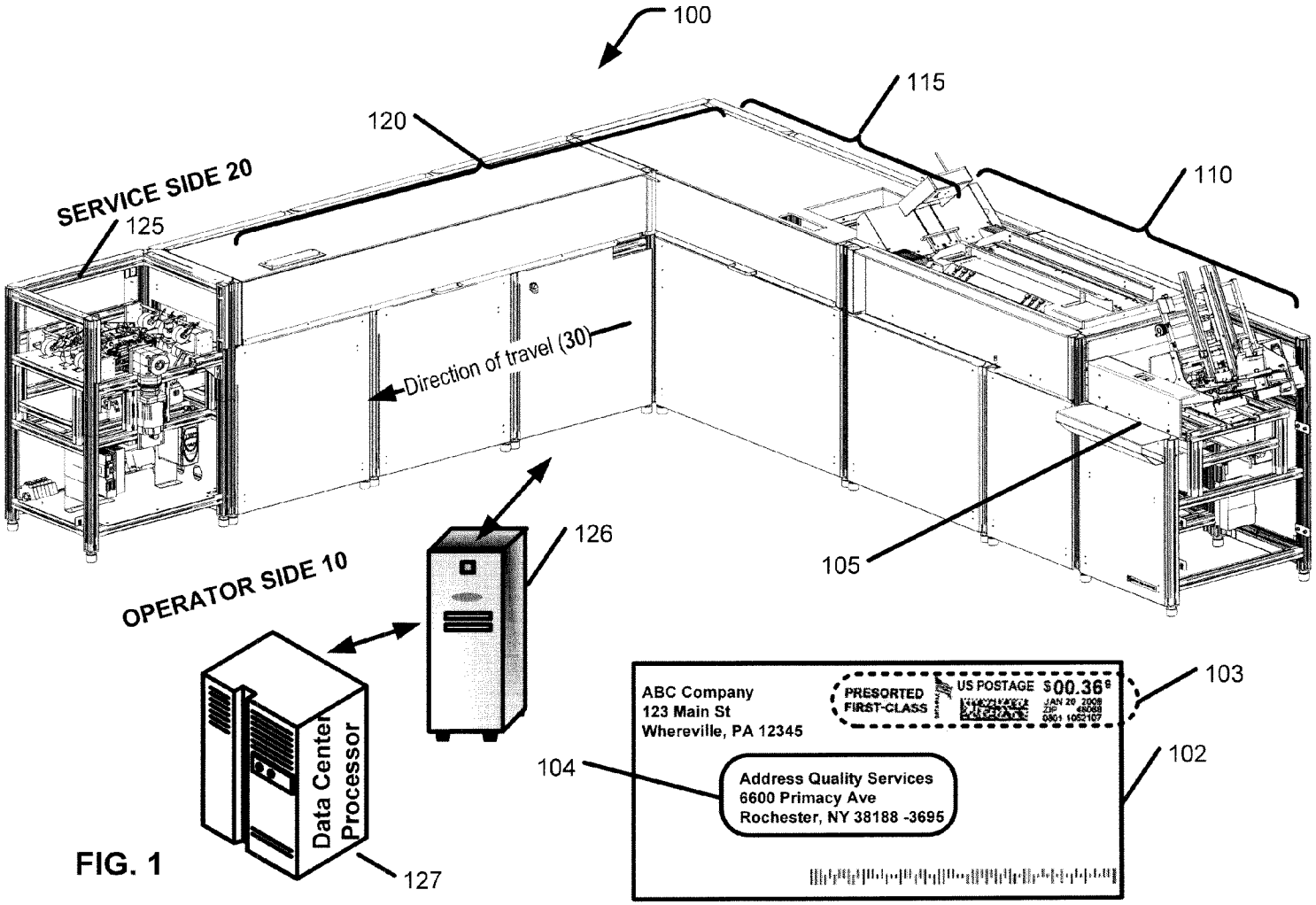
FIG. 1 is an exemplary illustration of an inserting system containing the turnover module.

Reference now is made in detail to the examples illustrated in the accompanying drawings and discussed below. FIG. 1 is an exemplary illustration of an inserter 100 that requires a turnover module 125 to complete the processing of an envelope 102 with material inserted within. Envelope 102 can be a letter or flat envelope, or instead of an envelope, stacks of material, such as documents, booklets, inserts or other mail items can be used. In this example the material is the contents of the envelope 102 to be delivered to an address. The insertion process starts with an input channel (not shown) that attaches to the insert feeder 105. The input channel processes rolled, fan folded or cut sheet documents such as an invoices or statements. The accumulated pages of the document are fed into the collation track 110 under the first insert feeder 105. Various numbers and configurations of insert feeders are distributed along the collation track 110 to feed the required inserts in a stack on top of the document. The stack of material is transported with pusher fingers to the stuffing engine 115 where the material is inserted into an envelope 102. Following insertion the envelope 102 enters the sealer and mail item conveyance transport 120 before being transported into the turnover module 125. Following the turnover module 125 is the output section (not shown) where postage indicia 103 maybe printed on the envelope and then stacked for removal from the inserter. The functions of the inserter 100 and the turnover module are controlled by one or more computers 126 and control and display devices (not shown). The system computer 126 maybe connected to a data center processor/server 127 for data communication with the processing resources to report job status and receive job inputs. Those skilled in the art will implement additional data exchanges and data formats and required by the equipment configurations in the document factory.

For purposes of explanation but not intended as a limitation, the operation of the turnover cage/holding assembly will be illustrated versus an envelope 102 entering the turnover module 125 from the right 30 (FIG. 2) with the address block 104 facing down. The location where the indicium 103 is to be printed is in the trailing position. For example, most postage meters require the address 104 to be facing up and the postage indicia 103 location on the top leading. Therefore, a turnover module 125 that inverts the envelope end for end, while maintaining the justification of the top edge of the envelope, with the address 104 facing up and the indicia print area leading is required. The direction of travel 30 through the machine is shown in numerous figures along with identification of the operator side 10 and the service side 20. These indications are for the purpose of orientation of the illustrations. The axis of rotation is perpendicular to conveyance. Those skilled in the art may incorporate numerous design configurations of the inserter 100 in order to meet customer requirements for machine performance and material and envelope characteristics. One design alternative is to place the turnover module between the collation track 110 and the stuffing engine 115. In this location the turnover module 125 would invert the material before it is inserted into an envelope with a flap down orientation. Many of the configurations of the turnover module 125 will require a modified version of the module to be integrated into an inserter for a wrapper machine. Additional turnover geometries, where the axis of rotation is not perpendicular to conveyance, are discussed in reference to FIG. 16. Examples of these inserters and wrappers that maybe integrated with the turnover module 125, include but are not limited to, the Bell and Howell COMBO, INVELOPER-wrapper, ENDURO and BH400.

Figure 2:
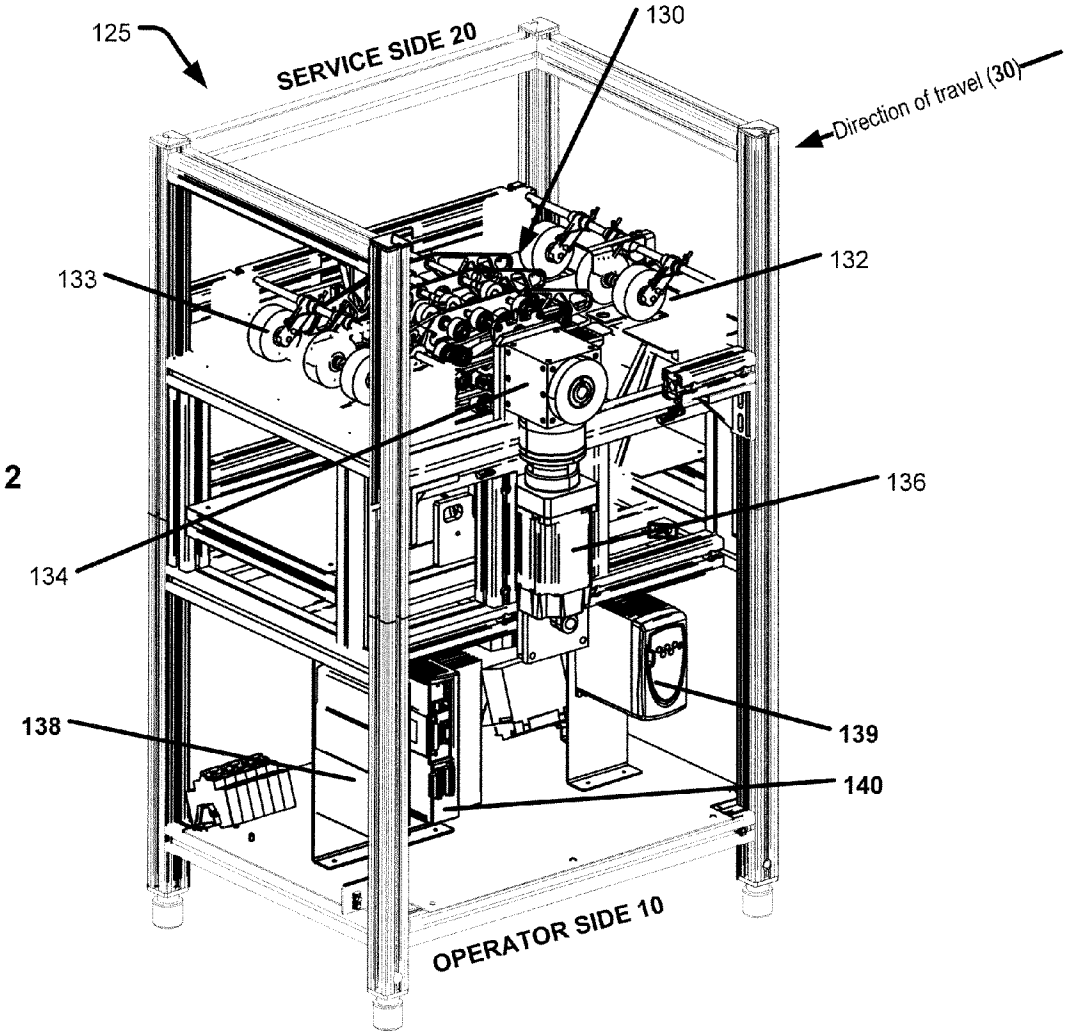
FIG. 2 is an exemplary illustration of the turnover module

Reference is now made to FIG. 2 for an illustration of the major components of the turnover module 125. The perspective for this illustration is from the operator side 10 with the mail item (e.g. envelope) to be inverted entering from the right (directional arrow 30). The active portion of the turnover module 125 is the turnover cage assembly 130 (referred to as the cage or holding assembly henceforth), which is described in depth in FIGS. 3 through 7. The cage assembly 130 is inverted by the invert servo motor 136 which drives the right angle gear box 134 to invert the cage assembly 130. Those skilled in the art may select other motor types besides a servo, such as but not limited to a stepper or DC motor. A servo was selected due to the fine resolution in speed and high torque. The invert servo controller 140 controls the motion profile for the invert servo motor 136. A series of three entry rollers 132 and three exit rollers 133 are controlled by the entry motor controller 139. The rollers 132, 133 that are illustrated in FIG. 2 are idler rollers. The drive rollers are beneath each roller but are not shown. These entry rollers 132 ensure that the material is input to the cage without slippage or the introduction of skew during the transition from the sealer and mail item conveyance transport 120 to the cage 130. Rollers 132 and 133 are mounted to the frame and are not part of the cage assembly 130 which rotates to create the invert turnover cage assembly 130 function.

Figure 3:
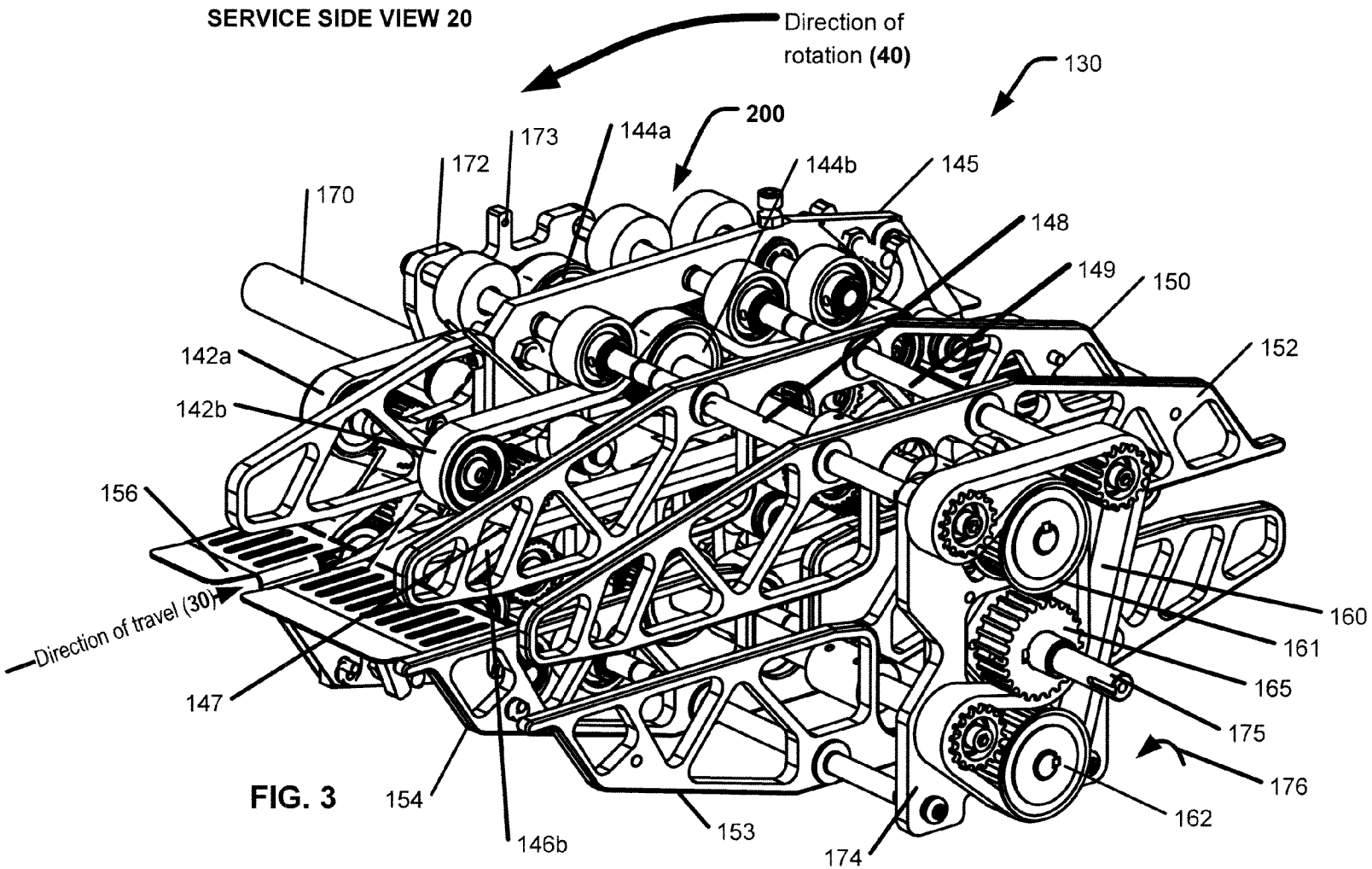
FIG. 3 is an exemplary illustration of the turnover cage assembly showing the conveyance drive mechanism.

FIG. 3 is an exemplary illustration of the turnover cage assembly 130 as viewed from the service side 20 with the mail item (e.g., envelope 102) entering the cage assembly 130 from the left. The invert sequence will invert the cage assembly 130 by rotating it in the counter clockwise 40 direction as seen from this perspective. The axis of rotation is formed by shaft 175 which is mounted to conveyance side plate 174 via a ball bearing and shaft 170 which is mounted to gearbox mounting plate 172 and is a part of the right angle gear box 134 (FIG. 2). The invert rotation can occur in either counter clockwise or clockwise direction as long as the motion profile for the conveyance servo motor 225 accounts appropriately with counter-rotation to compensate for the turnover motion. There are four conveyance belt drive assemblies, two on the upper and two on the lower, that are used to drive the mail item (e.g., envelope 102) into and out of the cage assembly 130. The conveyance assemblies are mounted to the conveyance center plate 145. The conveyance center plate 145 is supported by shafts 148 and 149 which are secured to the gearbox mounting plate 172 for right angle gear box 134 and to the conveyance side plate 174. A similar design exists for the lower conveyance system. The upper and lower conveyance systems are mostly symmetrical in layout and parts. As a result, the cage assembly 130 conveyance works equally well regardless of the orientation of the cage assembly 130. The upper conveyance assembly is noted by the mounting plate tab 173 which is on the gearbox mounting plate 172 for right angle gear box 134 (FIG. 2). When the mounting plate tab 173 is facing up, the upper conveyance is on top (home position). This is the orientation of the tab 173 for every other invert cycle. The conveyance system is driven by the conveyance servo motor 225 (FIG. 5) which connects via a pulley attached to drive shaft 175. The conveyance servo controller 138 controls the motion profile for the conveyance servo motor 225. Those skilled in the art may select other motor types besides a servo, such as but not limited to a stepper or DC motor. A servo was selected due to the fine resolution in speed and high torque.

For the exemplary illustration of FIG. 3, the drive shaft 175 is driven counter clockwise 176 to pull envelope 102 into the cage assembly 130. The drive shaft 175 is driven clockwise to remove the envelope 102 from the cage assembly after the invert is complete. The transmission belt 160 is driven by the conveyance drive pulley 165 which in turn drives the upper conveyance drive shaft via pulley 161 and the lower conveyance drive shaft via pulley 162. The upper and lower conveyances are both made up of an inside and outside belts 142*b* and 142*a* and 146*a* and 146*b* respectively. The reference numbers for like features are designated with (a) suffix for the outside conveyance and with (b) suffix for the inside conveyance. The inside and outside belts 142*b* and 142*a* are driven by the belt drive pulleys 144*b* and 144*a* respectively. Most of the lower conveyance system is not visible in FIG. 3 except for the lower inside belt 146*b*. The nip 147, where the mail item, such as envelope 102, enters the cage assembly 130, which is formed by the upper inside belt system 142*b* and the inside lower belt 146*b* is the area where the envelope 102 is pinched and pulled into the cage assembly 130. A guide plate 156 is provided at each end of the cage assembly 130 to assist the entry rollers 132 in guiding the envelope 102 into the nip 147. The maximum width of letter envelopes (approximately 6 inches) is roughly equal to the width of the guide 156. Since the cage assembly 130 is designed to handle letters and flats, upper frames 150 and 152 coupled with lower frames 154 and 153 are provided to support the wider material such as flat envelopes. This support is needed to prevent skew, slippage or jams at the input.

Figure 4:
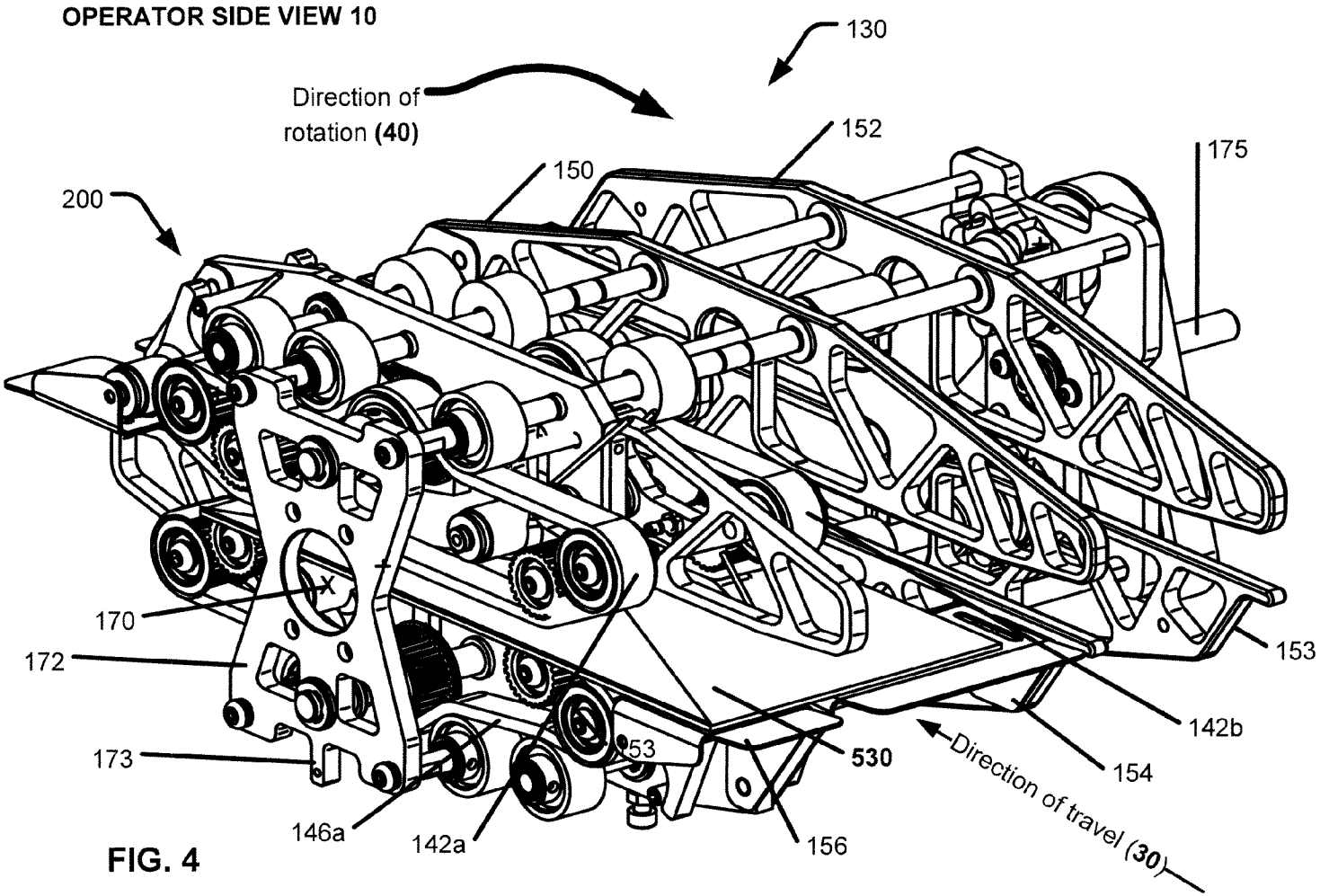
FIG. 4 is an exemplary illustration of the turnover cage mounting and axis of rotation.

FIG. 4 illustrates the cage assembly 130 from the operator side view 10 and in the inverted position since the tab 173 is oriented on the bottom (opposite). As mentioned earlier, the cage assembly 130 is designed to move material forward or backward while rotating and can start the turnover cycle with either the upper conveyance on top or on the bottom. For the perspective of FIG. 4, the mail item, such as envelope 530, enters from the right side (directional arrow 30) and the direction of rotation 40 is clockwise. The envelope 530, shown inside the cage 130, is a letter size envelope with the address block 104 facing down and the envelope flap 535 facing up. The current design accommodates both letter and flat envelopes in addition to other mail items such as stacks of material, including documents, booklets and inserts. The large variety of material can be accommodated as a result of the design of the guide 156, the frames 150, 152, 153 and 154 plus the tight grip of the tensioned belts 142*a*, 142*b*, 146*a* and 146*b* (not shown). Another key feature of the turnover is straight conveyance path through the cage assembly 130 which requires no bending or folding of the material or envelope. The turnover sequence can by skipped by not activating the invert servo motor 136 (FIG. 6) during the turnover sequence. This straight through the turnover module 125 option can be useful for certain operational requirements. The right angle gear box mounting plate 172 is shown with the center of rotation indicated by an X 170 since the shaft is not shown in this illustration. The other support for the axis of rotation is shaft 175.

Figure 5:
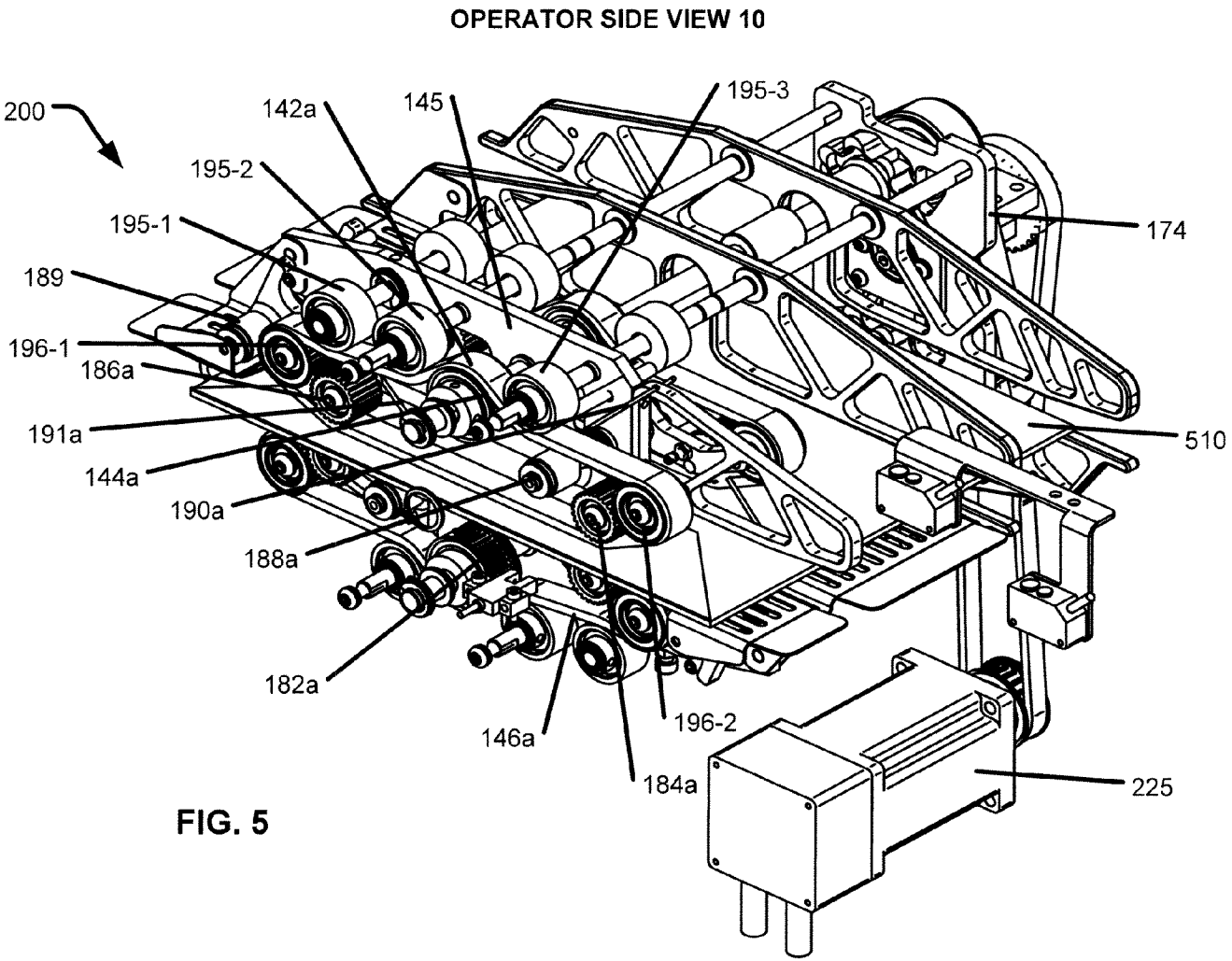
FIG. 5 is an exemplary illustration of the belt drive system used for conveyance of material in the turnover cage assembly.

FIG. 5 is the same view as FIG. 4 except the mounting plate 172 for the right angle gear box is removed to allow for illustration of the conveyance components. The explanation of the conveyance components is limited to the outside upper conveyance since the inside and lower conveyance components are functionally the same as the outside conveyance components. The conveyance system 200 of the cage assembly 130 includes the outside upper and lower conveyance belts 142*a* and 146*a*, respectively, and their accompanying pulleys, the inside upper and lower conveyance belts 142*b* and 146*b*, respectively, and their accompanying pulleys. The design requires that the conveyance belts have no slippage and are tensioned to tightly grip the envelope (or other mail item) while allowing for variable thickness. Both the upper conveyance belt 142*a* and the lower conveyance belt 146*a* are toothed belts that mate with the toothed upper drive pulley 144*a* and with the toothed lower drive pulley 182*a* respectively. To maintain tension around the drive pulley 144*a* and prevent tooth jumping, idler pulleys 195-1, 195-2 and 195-3 are positioned before and after the drive pulley 144*a*. End toothed pulleys 196-1 and 196-2 form the geometry of the conveyance belt 142*a* path. The tension on conveyance belt 142*a* is maintained for variable thickness envelopes using toothed idler pulleys 184*a*, 196-2 and 186*a*, 196-1 both of which are connected to a front swing arm assembly 188*a* and a rear swing arm assembly 189 respectively. Torsion springs 190*a* and 191 a provide the tensioning force to the swing arm assemblies. Pulleys 195-2, and 195-3 are mounted to shafts that support the conveyance side plate 145. The shafts through pulleys 195-2 and 195-3 also are mounted to the right angle gear box mounting plate 172 (not shown) and conveyance side plate 174 for support for the wrapping of the conveyance belt 142*a* around the support conveyance 174 and 172 drive pulley 144*a*. A similar arrangement of pulleys and tensioners are used on the lower conveyance belt 146*a* configuration and on the upper and lower inner conveyance system. These four conveyance belt assemblies reliably convey variable thickness (0.007 to ½ inch) material, letter envelopes 530 (FIG. 4) and flat envelopes 510 without slippage or skew in a forward and reverse direction. Those skilled in the art may adjust the conveyance system components and geometry to accommodate material with different specifications beyond what is currently required.

Figure 6:
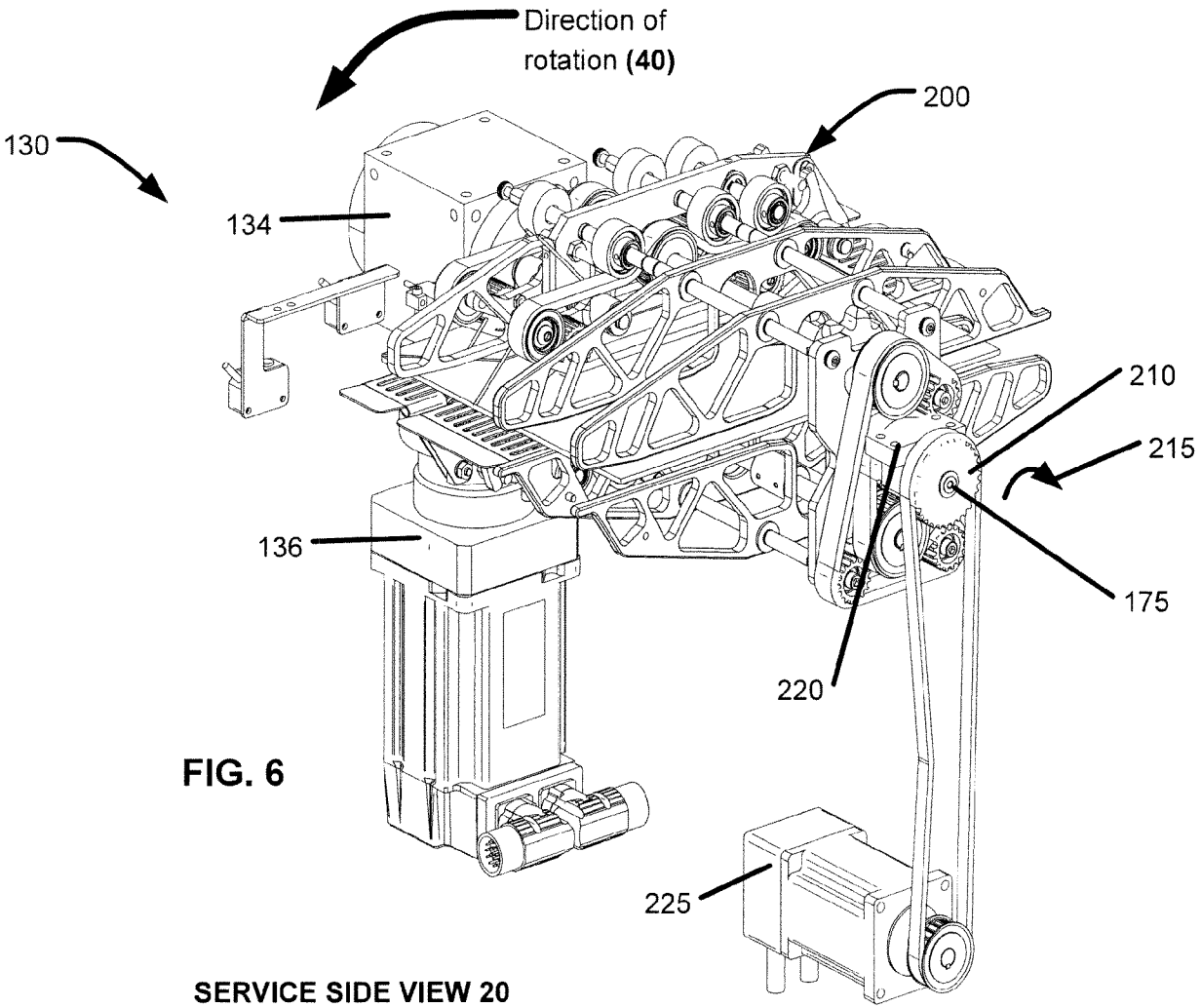
FIG. 6 is an exemplary illustration of the turnover conveyance drive and the turnover rotational drive.

Turning now to FIG. 6 for an illustration of invert servo motor 136 which drives the right angle gear box 134. The invert servo motor 136 is driven by the invert servo controller 140 which is controlled by the system computer 126. The controller can command the invert servo motor based on a motion profile or by discrete commands from the system computer 126. The speed of rotation and start and stop commands plus direction of rotation 40, which is counterclockwise when viewed from the service side 20, are the primary control commands. However, those skilled in the art may design for other motion profiles depending on the type of material being turned over or inverted. For example, but not limited to, the direction of rotation, speed of rotation depending on material length and stops to load an unload material from the cage 130. Conveyance servo motor 225 is driven by the conveyance servo motor controller 138 which in turn is controlled by the system computer 126 (FIG. 2).

The conveyance servo motor controller 138 commands the conveyance servo motor 225 (FIG. 6) based on a motion profile or by discrete commands from the system computer 126. The profiles are created in advance based on analysis and empirical data from test runs. Depending on the material to be inverted, the conveyance system 200 will pull the mail item (e.g. document, insert or envelope) into the cage assembly 130 with various acceleration/deceleration profiles to ensure that the material is positioned so that there will be no interference with other material or with parts of the turnover module 125 during the invert. The various acceleration/deceleration profiles for the conveyance servo motor 225 are designed to minimize the possibility of material damage or the creation of skew. One of the parameters that affect the profile is the envelope length. The time allocated to the turnover cycle maybe varied in relationship to the gap between envelopes on the mail item conveyance transport 120 and the transport speed. When the invert is complete, the envelope is accelerated out of the cage assembly 130 by running the conveyance servo motor 225 in the opposite direction from the direction used to move the envelope into the cage assembly 130. The invert servo motor 136 is controlled by the invert servo controller 140 using a motion profile and/or discrete commands. The job parameters, such as but not limited to, size of mail item, gap, conveyance speed and material characteristics effect the invert and conveyance motion profiles. Control flexibility is a key factor in getting the peak performance out of the turnover module and inserter or wrapper equipment. The conveyance speed can be varied continuously, both forward and backward, during the invert cycle regardless of the position of the cage assembly. Similarly, the invert servo controller can command the invert servo motor 136 to achieve a wide variety of profiles as needed to synchronize the turnover to the inserter/wrapper. As an example, the nominal time for the complete turnover cycle is 100 ms.

FIG. 6 illustrates the cage assembly 130 in the inverted position with the tooth drive pulley 210 mounted to shaft 175 and connected to the conveyance servo motor 225. Rotating the drive pulley 210 in the clockwise 215 direction will move the material out of the cage 130. Support for the rotation of the cage assembly 130 is provided the bearing block 220 and the right angle gear box 134. The motion profiles for the conveyance system 200 use the minimum acceleration and deceleration to minimize stress on the mail item thereby reducing the probability of jams or damage thereto.

Figure 7A:
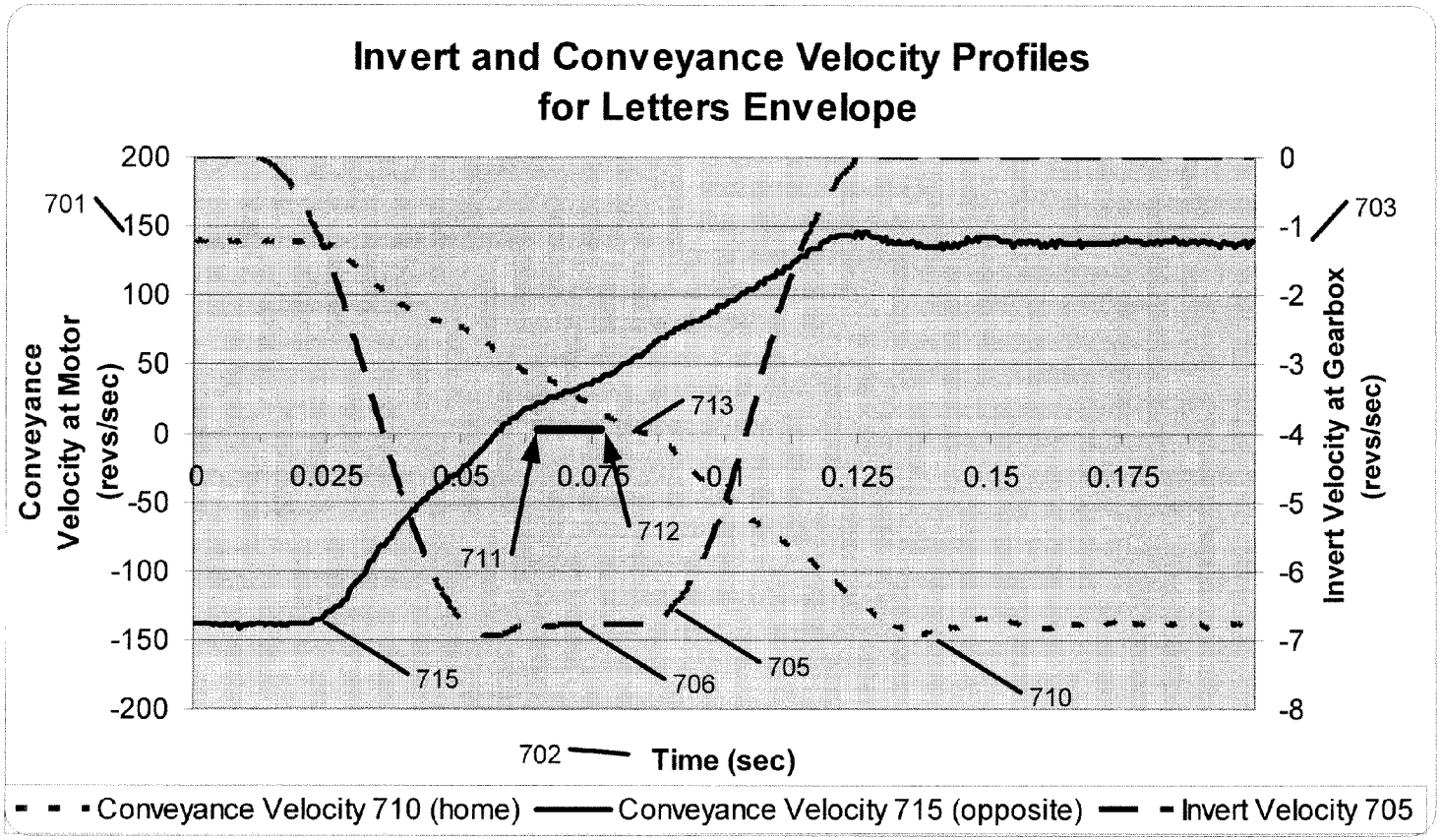
FIGS. 7*a* and 7*b* are exemplary graphs showing the invert and conveyance velocity motion profiles for letter and flat envelopes respectively.

Turning to FIG. 7*a* for an exemplary graph showing the motion profiles, for letter envelopes, that are used to control the invert 136 and conveyance 225 servo motors. The graph 710 shows the revolutions per second (RPS) for conveyance servo motor 225 when the conveyance system 200 is in the home position as indicated by the tab 173 (FIG. 3) facing up. The left hand Y axis 701 indicates the RPS of the conveyance servo motor 225 versus time in seconds as shown on the X axis 702. The motion profile for the invert servo motor 136, as measured at the output of the right angle gear box 134 (FIG. 2), is shown by graph 705. The right hand Y axis shows RPS at the gear box output versus time (X axis 702). Interdependent motion, which is caused when multiple motions are required at the same time as exhibited by the conveyance system 200 and the invert servo motor 136 and gear box 134 FIG. 2 running simultaneously, requires that the motion profiles for each servo motor take into account the interdependent motion. FIG. 3 illustrates the linkage that introduces the interdependent motion. The belt path for the transmission belt 160 does not follow a symmetrical path around the upper and lower conveyance dive shaft pulleys (161 and 162 respectively). Therefore the motion profile for the conveyance system 200 will be different depending on whether the conveyance system is in the upper (home) position (graph 710) or inverted position (opposite) (graph 715). In addition, the invert axis of rotation 175, 170 also includes the conveyance drive pulley 165 for the transmission belt 160. Rotation of the conveyance system 200 about the conveyance drive pulley 165 will cause the transmission belt 160 to move. The motion profile must account for this motion in order to have the envelope move through the conveyance system 200 correctly. For example, the envelope is stopped instantaneously between approximately 0.0625 seconds (711) to 0.08 seconds (712) when the cage assembly 130 has rotated through the 90 degree point 706. However, the conveyance servo motor 225 does not pass through the zero velocity point 713 until after the 90 degree point 706 has occurred. This illustrates that the conveyance servo motor 225 must continue to rotate while the envelope is stopped due to the interdependent motion caused by the invert rotation of the cage assembly 130.

Figure 7B:
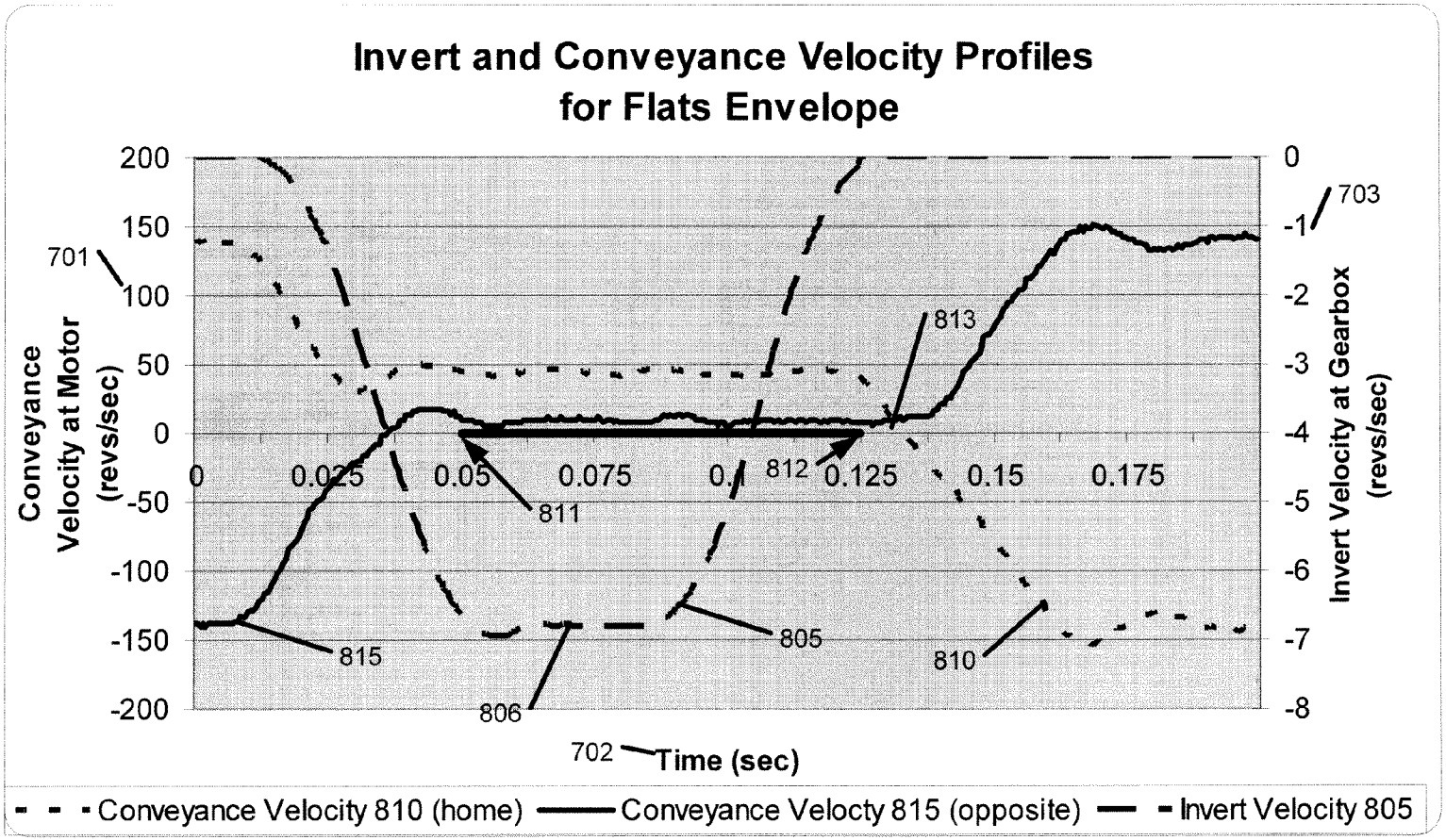

Turning to FIG. 7*b* for an exemplary graph showing the motion profiles, for flat envelopes, that are used to control the invert 136 and conveyance 225 servo motors. The graph 810 shows the revolutions per second (RPS) for conveyance servo motor 225 when the conveyance system 200 is in the home position as indicated by the tab 173 (FIG. 3) facing up. The left hand Y axis 701 indicates the RPS of the conveyance servo motor 225 versus time in seconds as shown on the X axis 702. The motion profile for the invert servo motor 136, as measured at the output of the right angle gear box 134 (FIG. 2), is shown by graph 805. The right hand Y axis shows RPS at the gear box output versus time (X axis 702). Interdependent motion, which is caused when multiple motions are required at the same time as exhibited by the conveyance system 200 and the invert servo motor 136 and gear box 134 (FIG. 2) running simultaneously, requires that the motion profiles for each servo motor take into account the interdependent motion. FIG. 3 illustrates the linkage that introduces the interdependent motion. The belt path for the transmission belt 160 does not follow a symmetrical path around the upper and lower conveyance dive shaft pulleys (161 and 162 respectively). Therefore the motion profile for the conveyance system 200 will be different depending on whether the conveyance system is in the upper (home) position (graph 810) or inverted position (opposite) (graph 815). In addition, the invert axis of rotation 175, 170 also includes the conveyance drive pulley 165 for the transmission belt 160. Rotation of the conveyance system 200 about the conveyance drive pulley 165 will cause the transmission belt 160 to move. The motion profile must account for this motion in order to have the envelope move through the conveyance system 200 correctly.

For example, the envelope is stopped from approximately 0.05 seconds (811) to 0.125 seconds (812) when the cage assembly 130 has rotated through the 90 degree point 806. This illustrates that the conveyance servo motor 225 must continue to rotate at approximately 50 RPS when the cage is at (home) and 5 RPS when at (opposite) positions. During this time the envelope is stopped with respect to the cage assembly due to the interdependent motion caused by the invert rotation of the cage assembly 130.

FIGS. 7*a* and 7*b* are exemplary motion profiles and are not intended to limit the design options of those skilled in the art to account for the cage assembly design or for the preferred transport motion of the material to be inverted through the conveyance system 200. Other design considerations, which require motion profiles that are coordinated but independently control the invert servo 136 and the conveyance servo motor 225, include but are not limited to, the gap between mail items, the geometry of the cage assembly conveyance drive configuration, the motion coupling between the invert and conveyance motion profiles and the conveyance speeds in the inserter. An additional advantage of the independent motion profile is the ability to inhibit operation of the invert servo, which results in the mail item being passed directly through the cage assembly without being inverted. This feature is needed for insertion machines that have the versatility to process mail items with the flap up or the flap down. No chances are required to the down stream mail item envelope conveyance transport 120 since the mail item exits the cage assembly at the same deck height regardless of whether or not the mail item is inverted. Each motion profile is programmable, either manually at setup or automatically.

Figure 8:
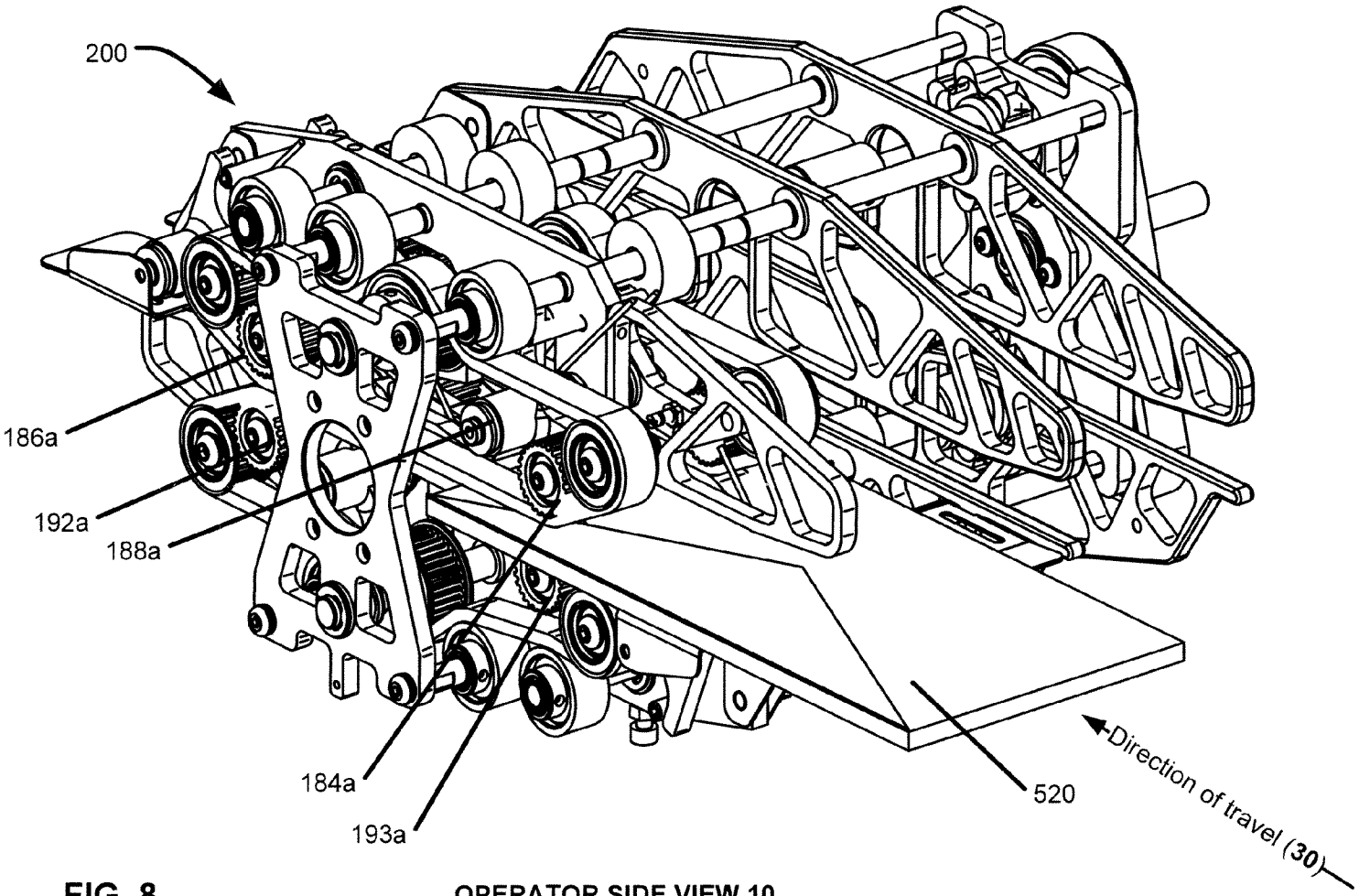
FIG. 8 is an exemplary illustration of the material thickness compensation configuration.

Attention is now turned to FIG. 8 to illustrate the components that enable the conveyance system 200 to convey mail items with large varieties of thickness and material type. From the operator side view 10, the thick envelope 520 enters the conveyance system 200 from the right (directional arrow 30) of the illustration. Toothed idler pulleys 184*a* and 193*a* are forced apart by the envelope 520 while the upper swing arm assembly 188*a* and its lower counter part swing arm assembly (not shown) maintain a tight grip on the envelope 520 due to the action of torsion springs attached to each swing arm assembly. Toothed idler pulleys 186*a* and 192*a* are also forced apart by the envelope 520 and are mounted on another set of swing arms. Toothed idler pulley 196-2 and 196-1 also serve as belt "take up" devices and maintain the belt tension through the motion of the swing arms and pulleys. Coupled with the inside upper and lower conveyance assemblies, the thick material is positively controlled from skew or slippage.

Figure 13:
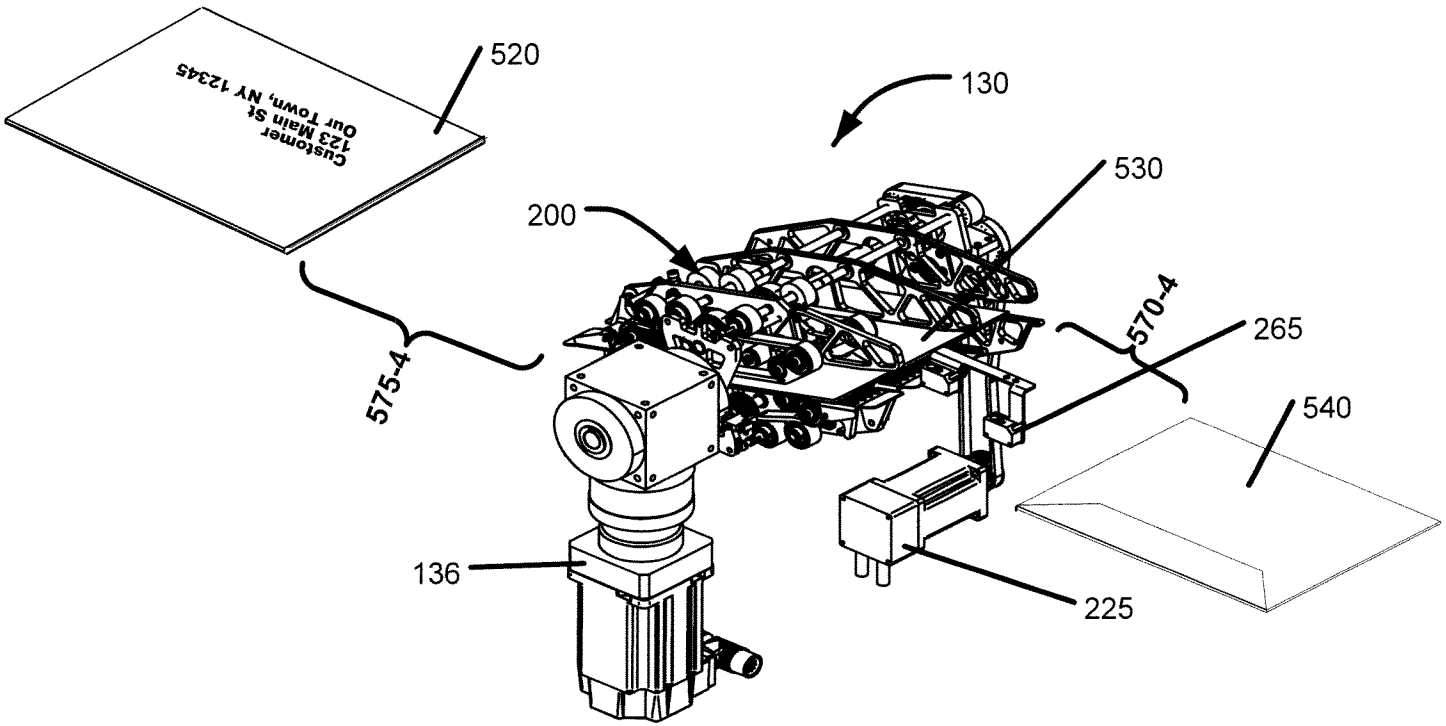
FIG. 13 is an exemplary illustration of the turnover sequence nearing the end of the turnover sequence.
Figure 14:
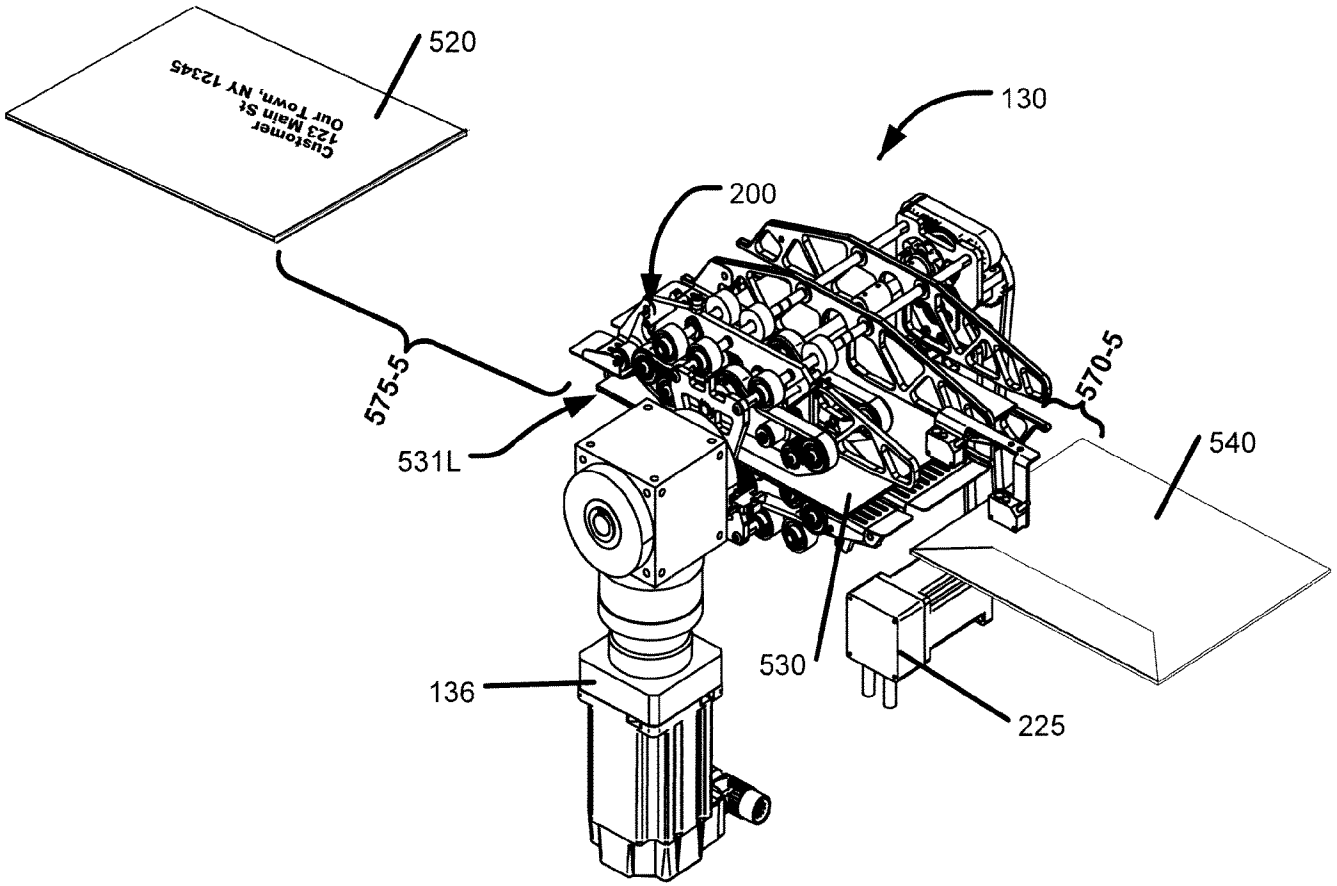
FIG. 14 is an exemplary illustration of the turnover sequence at the completion of turnover sequence and the input of the next piece of material to be inverted.
Figure 15:
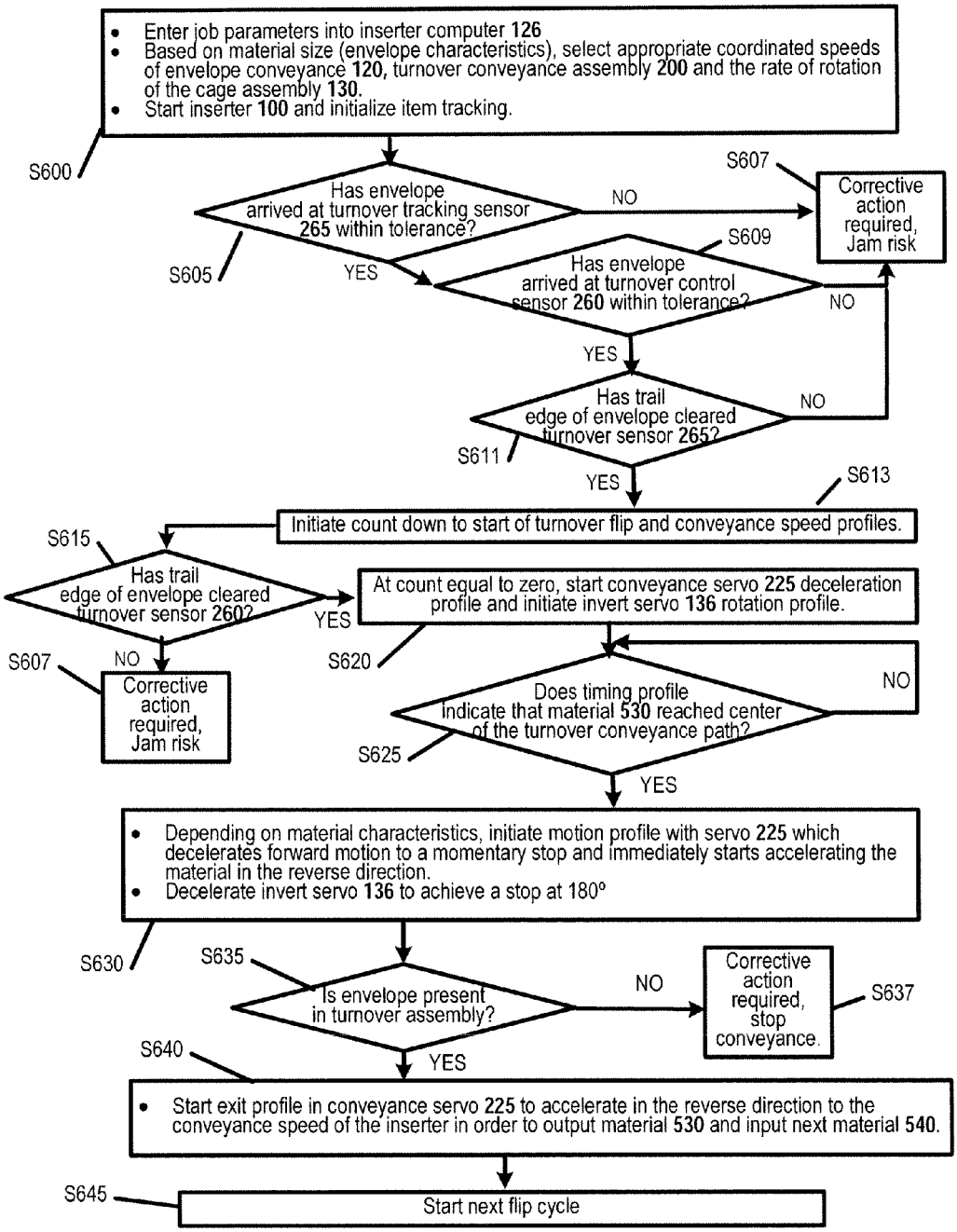
FIG. 15 is an exemplary process flow diagram of the turnover sequence.

Reference is now made to FIG. 15 for the exemplary steps that make up the turnover (invert) sequence and to FIGS. 9 through 14 to illustrate the exemplary invert sequence. When references are made to steps in FIG. 15 during the explanation of FIGS. 9 through 14, the reference numbers are all preceded by an S to distinguish them from other figure references. FIGS. 9 through 14 are illustrated from the Operator Side View 10 and the mail item (e.g., 520, 530, 540) to be inverted is moving from right to left (directional arrow 30). The mail item (e.g., 520, 530, 540) to be inverted is shown as an envelope for this exemplary invert sequence. Other materials such as, but not limited to inserts, booklets and documents can be inverted as well. The stack of material or letter size envelopes are typically not be less than 6¾ inches long, 4½ inches high, and 0.007-inch thick and typically not more than 11½ inches long, or more than 6⅛ inches high, or greater than ¼-inch thick. The stack of material or flat size envelopes are typically more than 11½ inches long or typically more than 6⅛ inches high, or typically more than ¼ inch thick and not typically more than 15 inches long or not typically more than 12 inches high or not more than ½ inch thick. The mail item (e.g., 520, 530, 540) shown in FIGS. 9 through 14 is a flat size envelope with the flap 535 up before the invert and the address block 104 up after the invert. At the conclusion of the invert FIG. 14, the trailing edge of the envelop FIG. 9 531 T becomes the leading edge 531 L FIG. 14. The orientation of the envelope is now correct for printing indicia 103 or other post processing steps such as endorsement line printing.

Figure 9:
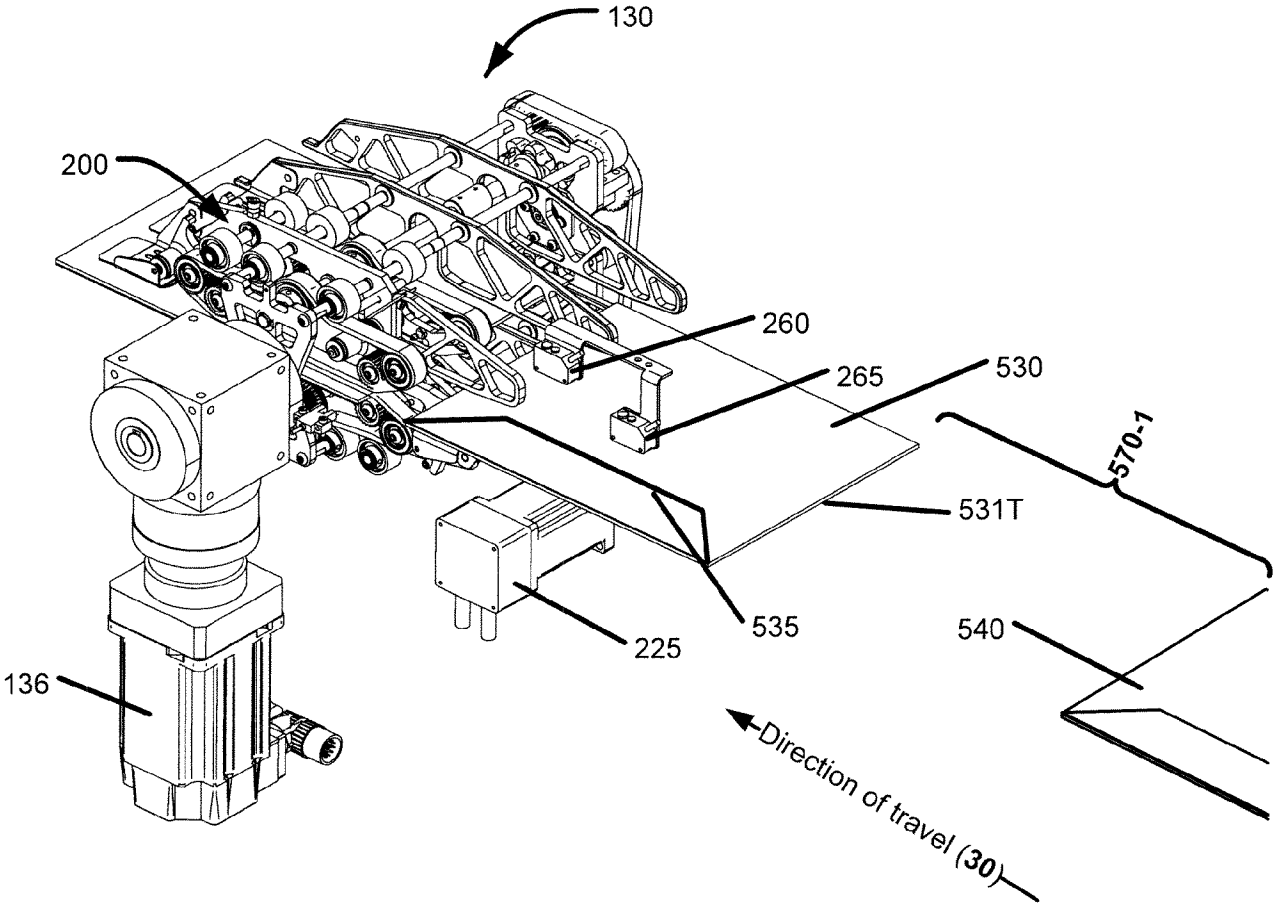
FIG. 9 is an exemplary illustration of the turnover sequence transition point between turnover sequences.

In FIG. 15, The invert sequence starts with step S600 with the entry of job parameters into the inserter computer 126. Based on the size of the mail item (e.g., envelope characteristics) and the speed of the mail item conveyance transport 120, the turnover assembly 130 servo motor controllers 138 and 140 coordinate the conveyance speed and the rate of rotation of the cage assembly 130 respectively. The inserter is now ready to be started and tracking of each item in the inserter is begun. The finished envelope (material inserted and envelope sealed) is tracked to the tracking sensor 265 (FIG. 9) in the turnover module 125. Step S605 determines if the envelope 530 has arrived within the expected time of arrive, including a tolerance that accounts for acceptable slippage or speed variation. If the envelope 530 has not arrived at the tracking sensor 265 within the tolerance, this is indicative that a jam condition has occurred or there will be insufficient gap between envelopes to allow for a successful invert. Corrective action step S607 is required which may include stopping the inserter. If the envelope 530 has arrived in time S605, the tracking test is repeated with the turnover control sensor 260 step S609. If the envelope 530 has not arrived in time, corrective action is required S607. FIG. 9 shows envelope 530 entering the turnover cage assembly 130 having been detected by sensors 265 and 260. Sensors 265 and 260 may be a photo sensor sender and receiver pair, proximity sensor or other sensor capable of detecting presence of paper material. The conveyance system 200 is driven by the conveyance servo motor 225 at the same speed as the mail item conveyance transport 120. The standard gap 570-1 between envelopes 530 and the next envelope 540 is still at the size dictated by the mail item conveyance transport 120. The cage assembly 130 is at the zero position. Since the transport speed and envelope length is known, the time when the trailing edge 531T will clear the turnover tracking sensor 265 is known S611. If the trailing edge of envelope 530 is not detected within the set tolerance, corrective action is required S607. If the trailing edge 531T is detected within the timing tolerance S611 the turnover count down sequence is initiated S613. The conveyance system 200 driven by the conveyance servo motor 225 will initiate a speed profile to pull the envelope 530 into the cage assembly 130, decelerate the envelope to a momentary stop and then accelerate the envelope back to mail item conveyance transport speeds. Step S615 monitors control sensor 260 to detect the trailing edge 531T. If the trailing edge is detected within the time tolerance, the speed and movement profiles for the conveyance servo motor 225 and for the invert servo motor 136 respectively will be initiated when the count down reaches zero, step S620. If the time tolerance is exceeded, corrective action is required S607.

Figure 10:
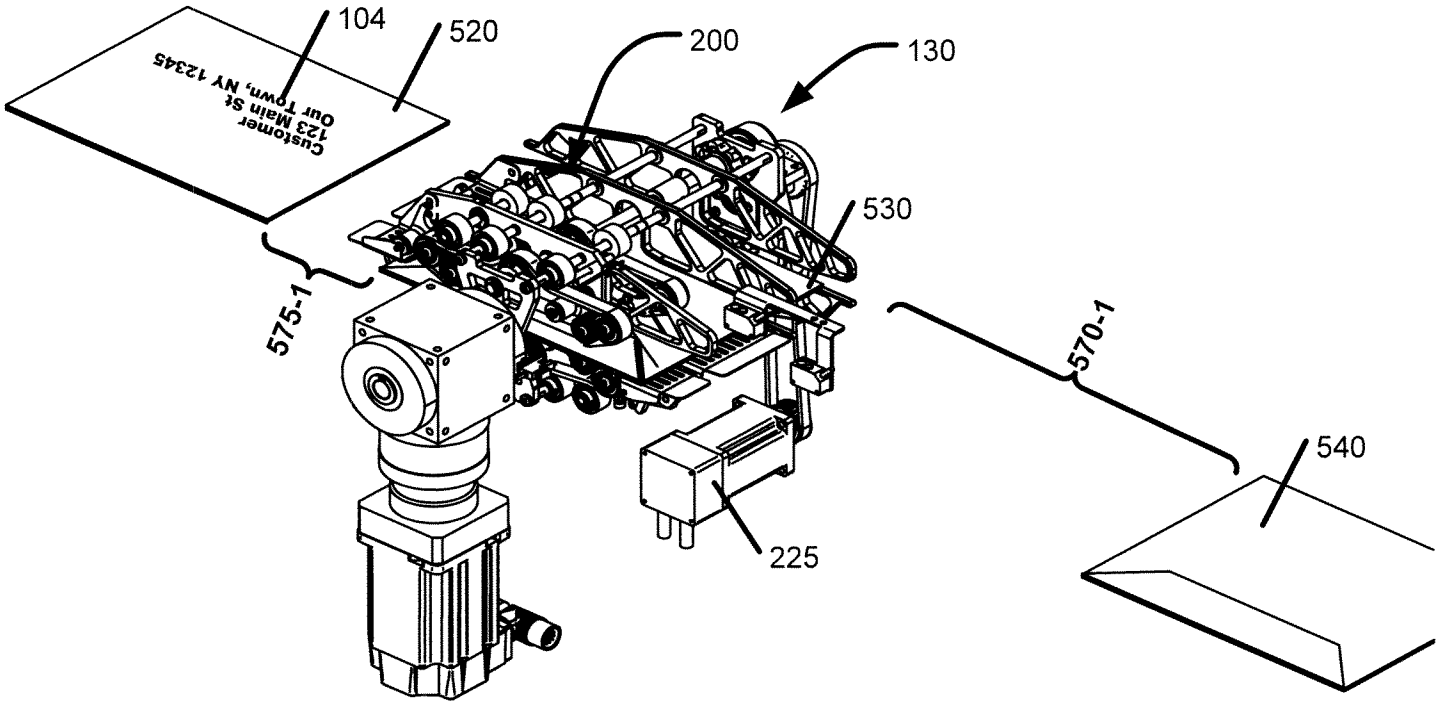
FIG. 10 is an exemplary illustration of the turnover sequence of the turnover start of rotation.
Figure 11:
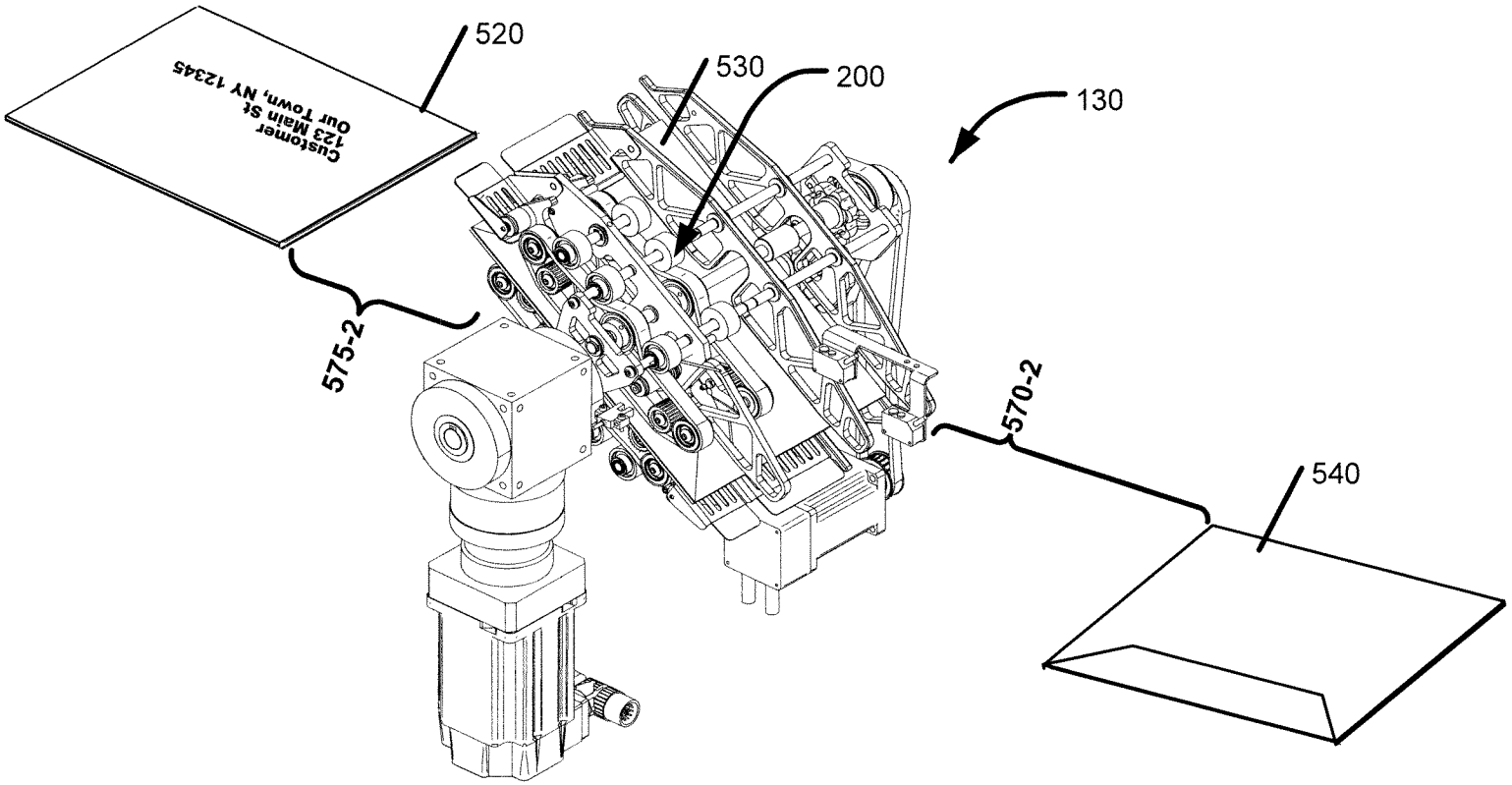
FIG. 11 is an exemplary illustration of the turnover sequence at 45 degrees of rotation
Figure 12:
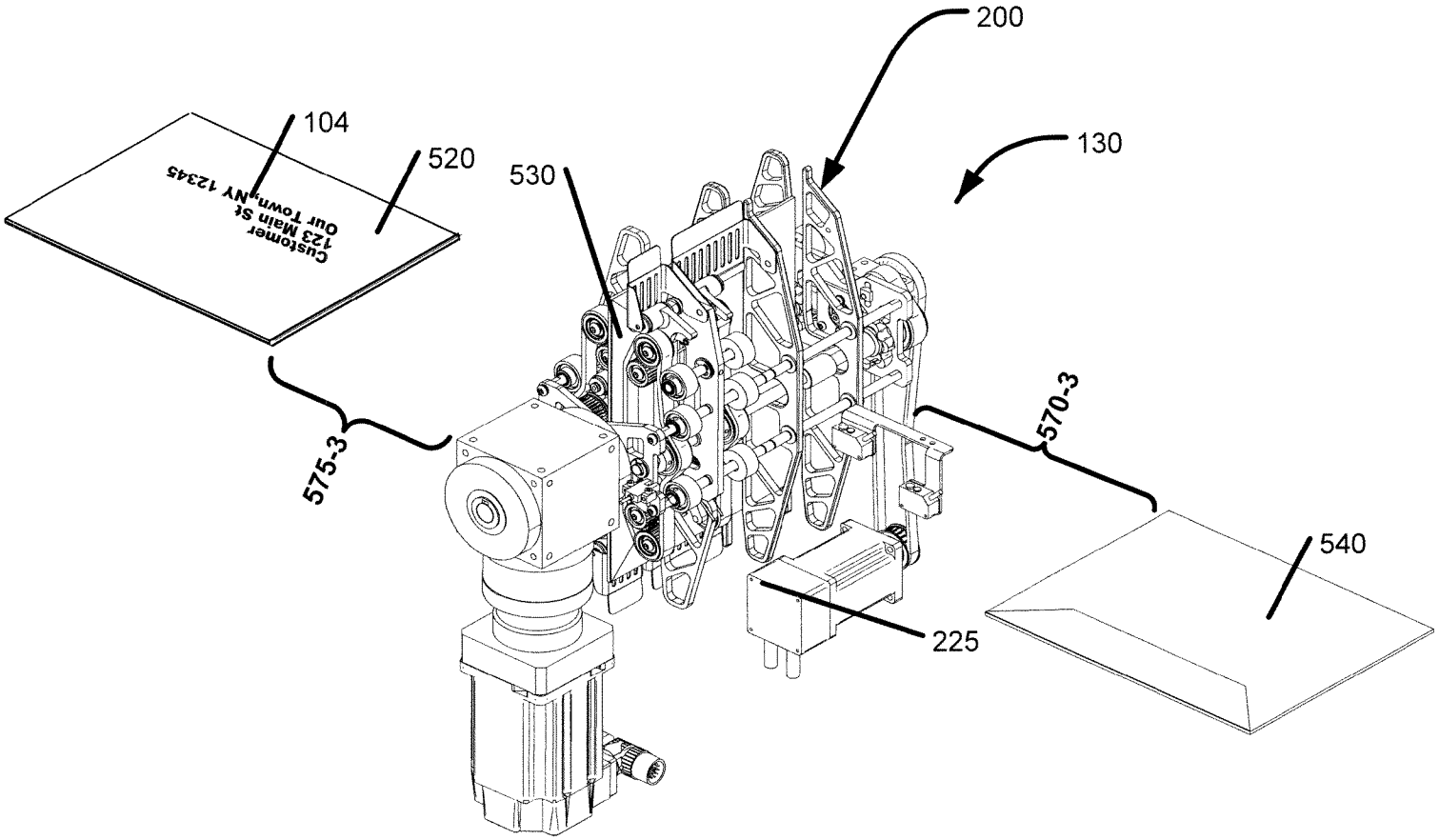
FIG. 12 is an exemplary illustration of the turnover sequence at 90 degrees of rotation.

FIG. 10 is an exemplary illustration of the envelope 530, to be inverted, loaded into the cage assembly 130. The next envelope 540 to be inverted is still a standard gap distance away 570-1 while envelope 520 has been inverted and removed from the cage assembly 130 with the address block 104 facing up. The gap 575-1 is still small since envelope 520 has not been moving at the mail item conveyance transport 120 speed while in the cage assembly 130. The conveyance system 200 is decelerating the envelope 530 in accordance with the prescribed control profile for the conveyance servo motor 225. FIG. 11 illustrates the cage assembly 130 rotated approximately 45 degrees and the envelope 530 significantly decelerated in its forward motion through the conveyance system 200. The gap 570-2 between envelope 540 and the turnover is decreasing while the gap 575-2 between envelope 520 and the turnover is increasing.

When the envelope 530 has reached the center of the conveyance system 200 (FIG. 12), step S625, and the cage assembly 130 has rotated approximately 90 degrees, the envelope 530 will come to a momentary stop and then reverse direction in accordance with the motion profile for the conveyance servo motor 225 (first bullet of step S630). The gap 570-3 between envelope 540 and the cage assembly 130 continues to decrease while the gap 575-3 between the cage assembly 130 and the inverted envelope 520 continues to increase.

FIG. 13 shows the cage assemble 130 nearing 180 degrees of rotation, a complete turnover. The motion profile for the invert servo motor 136 is decelerating the rate of rotation for the cage assembly 130, S630. The motion profile for the conveyance servo motor 225 has slowed conveyance system 200 and the envelope 530 to a very slow rate in the reverse direction. Envelope 540 is nearly at the tracking sensor 265 and the gap 570-4 to the cage assembly 130 is almost zero. The inverted envelope 520 has moved away from the cage assembly 130 creating a gap 575-4 that is nearly equal to the standard gap used in the mail item conveyance transport 120, FIG. 1.

As illustrated in FIG. 14, the cage assemble 130 has completed the invert and is stopped rotation. The envelope 530 is address side up and the leading edge 531 L is now the former trailing edge 531T. Gap 570-5 is at the minimum since envelope 540 is about to enter the conveyance system 200. Envelope 520 is now at the standard gap distance 575-5 from envelope 530. Before envelope 530 is moved out of the conveyance system 200, item present sensor (not shown) on the cage assembly 130 verifies that envelope 530 is still present, S635. If envelope 530 is not present due to a jam, damage, a fly out or control error, corrective action possibly including a stop S637 is required. If the item present sensor has detected the envelope 530, the conveyance servo motor 225 accelerates the conveyance system 200 and envelope 530 in the reverse direction into the mail item conveyance transport 120 at speed, S640. Envelopes 520 and 530 are transported to post processing and envelope 540 is loaded into the cage assembly 130. The next invert cycle is started, S645.

In addition to using the turnover module 125 to flip material and envelopes, it can be used to divert defective items or purge items that no longer should be mailed, such as but not limited to a dunning notice for an account that has been restored. For example, if the cage assembly 130 in FIG. 13 was momentarily stopped at an angle similar to that illustrated in FIG. 13, the conveyance system 200 would be driven in the reverse direction to divert envelope 530 into a divert bin mounted above envelope 540. Similarly, the conveyance system 200 would be driven in the forward direction to divert envelope 530 into a divert bin mounted below envelope 520. The motion profile control system would accommodate the required commands based on instructions from the inserter control computer 126.

Figure 16:
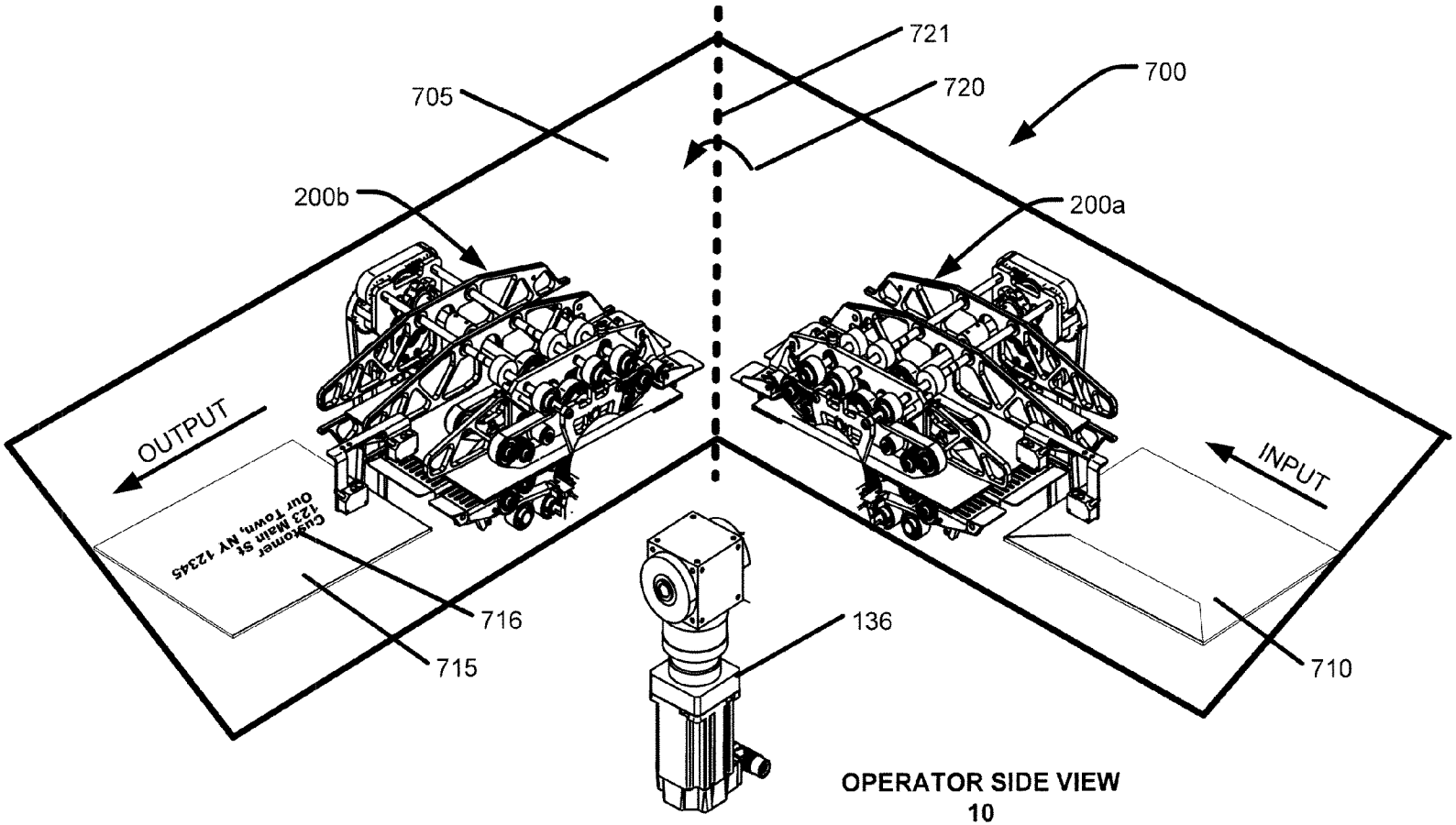
FIG. 16 is an exemplary example of an alternate implementation of the cage assembly turnover process.

FIG. 16 illustrates one of many possible configurations for the turnover module 125 (FIG. 1) depending on the available floor space and turnover requirements. For example, the design layout may require that the turnover module be located between the stuffing engine 115 and the envelope conveyance transport 120. The design disclosed herein can meet the duel purpose of flipping the material end for end and completing a 90 degree turn. The 90 degree turnover module 700 FIG. 16 is comprised of an L shaped plate 705 on which are mounted two cage assemblies 200*a* and 200*b* the are that are oriented 90 degrees relative to each other. Angles other than 90 degrees can be accommodated by those skilled in the art as required by system constraints. Design modifications to the drive system for the conveyance systems 200*a* and 200*b* are required. The input envelopes (flap up) 710 enter the conveyance system 200*a* from the right and the envelope 715 (address up 716) exits the conveyance system 200*b* to the left side of the 90 degree turnover module. Each time the 90 degree turnover module 700 is rotated 180 degrees counter clockwise 720, about the axis of rotation 721, the upper and lower conveyance systems are exchanged and the envelope is flipped end for end. Changes to the conveyance system 200*a* and 200*b* servo motor motion profile are required. The motion profile for the invert servo motor 136 also are modified. Significant design flexibility is available for those skilled in the art to make adjustments to the approach disclosed herein for custom versions of the straight and the 90 degree turnover module.

As shown by the above discussion, functions relating pertain to the operation of an inserting system with a turnover module 125 implemented in the hardware and controlled by one or more computers operating as the system control processor 126 connected the inserting system. The system computer 126 maybe connected to a data center processor/server 127 for data communication with the processing resources as shown in FIG. 1. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer that functions as the control processor 126 and/or the associated terminal device. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for tracking of mail items through a postal authority network with reference to a specific mail target, in essentially the manner performed in the implementations discussed and illustrated herein.

Figure 17:
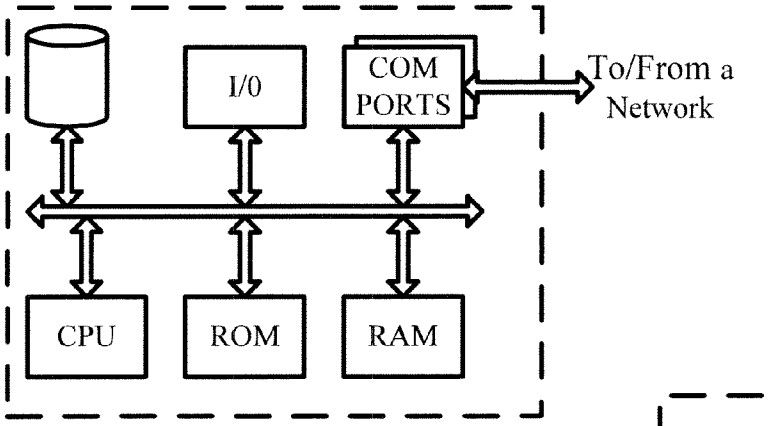
FIG. 17 illustrates a network or host computer platform, as may typically be used to implement a server.
Figure 18:
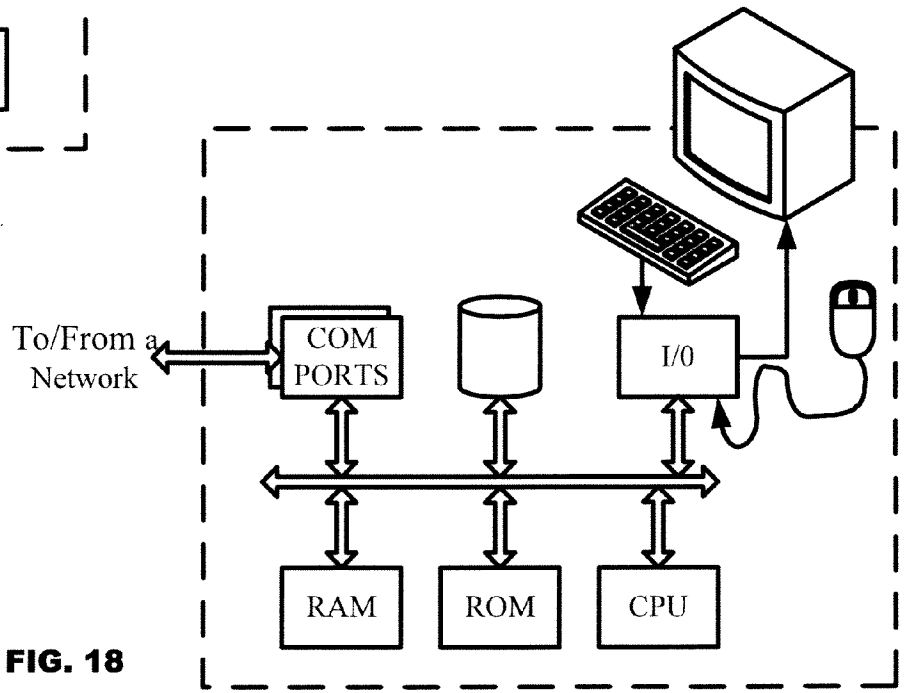
FIG. 18 depicts a computer with user interface elements, as may be used to implement a personal computer or other type of work station or terminal device.

FIGS. 17 and 18 provide functional block diagram illustrations of general purpose computer hardware platforms. FIG. 17 illustrates a network or host computer platform, as may typically be used to implement a server. FIG. 17 depicts a computer with user interface elements, as may be used to implement a personal computer or other type of work station or terminal device, although the computer of FIG. 17 may also act as a server if appropriately programmed. It is believed that those skilled in the art are familiar with the structure, programming and general operation of such computer equipment and, as a result, the drawings should be self-explanatory.

For example, control processor 126 may be a PC based implementation of a central control processing system like that of FIG. 17, or may be implemented on a platform configured as a central or host computer or server 127 like that of FIG. 18. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for tracking of mail items through a postal authority network with reference to a specific mail target, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model—i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer (s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

In the detailed description above, numerous specific details are set forth by way of examples in order to provide a thorough understanding of the relevant teachings. However, it should be apparent to those skilled in the art that the present teachings may be practiced without such details. In other instances, well known methods, procedures, components, and software have been described at a relatively high-level, without detail, in order to avoid unnecessarily obscuring aspects of the present teachings.

What is claimed is:

1. An apparatus for inverting a mail item having a leading and trailing end, the apparatus comprising:

a rotatable cage assembly having an input guide section for receiving the mail item from an upstream direction of feeder path by the leading edge of the mail item, the rotatable cage configured to:

rotate about an axis of rotation; and invert the mail item during rotation of the rotatable cage about the axis of rotation;

a bi-directional drive mechanism to convey the mail item while it is contained in the rotatable cage assembly in accordance with a variable motion profile, the bi-directional drive mechanism configured to:

convey the mail item with its leading end forward in a first direction away from the input guide section of the cage assembly, and convey the mail item while it is contained in the rotatable cage assembly with its trailing edge forward in a second direction towards the input guide section during rotation of the rotatable cage about the axis of rotation such that the inverted mail item exits the rotatable cage in a direction towards a downstream direction of the feeder path.

2. The apparatus according to claim 1, wherein the mail item is selected from an envelope, a document of one or more sheets, a booklet or insert.

3. The apparatus according to claim 1, further comprising an invert servo motor for rotating the cage assembly about its axis of rotation.

4. The apparatus according to claim 1, further comprising a sensor for detecting the mail item at the input guide section.

5. The apparatus according to claim 1, wherein the rotatable cage assembly inverts the mail item from a face-down to a face-up orientation such that the trailing edge becomes the leading edge, wherein the face-up orientation includes a region for address information to be printed thereon.

6. The apparatus according to claim 1, wherein the rotatable cage assembly further comprises one or more belts for conveying the mail item while contained in the rotatable cage assembly.

7. The apparatus according to claim 1, wherein the rotatable cage assembly has an upper and lower conveyance system and conveyance servo motor for mail item conveyance.

8. The apparatus according to claim 1, wherein the belts are spring loaded to accommodate different thicknesses of mail items.

9. The apparatus according to claim 1, the mail item enters and exits the rotatable cage assembly on the same plane as the feeder path.

10. The apparatus according to claim 1, wherein the axis of rotation of the rotatable cage assembly is perpendicular to the feeder path.

11. The apparatus according to claim 1, wherein the variable motion profile is controlled by a processor and varies depending on the rotation of the rotatable cage assembly and conveying of the mail item within the rotatable cage assembly.

12. A method of inverting a mail item, the method comprising steps of:

receiving a mail item from an upstream direction of a feeder path at an input guide section of a rotatable cage assembly;

detecting a leading edge of the mail item as it enters the rotatable cage assembly;

decelerating a first forward motion of the mail item upon detection of the leading edge of the mail item within the rotatable cage;

rotating the cage assembly about an axis of rotation while the mail item is contained within the case assembly; and conveying the mail item while it is contained in the rotatable cage assembly with its trailing edge forward in a second direction towards the input guide section during rotation of the rotatable cage about the axis of rotation such that the inverted mail item exits the rotatable cage in a direction towards a downstream direction of the feeder path, wherein rotation of the cage assembly and conveyance of the mail item within the cage assembly are independently controlled and coordinated by a variable motion profile.

13. The method according to claim 12, wherein the rotatable cage assembly inverts the mail item from a face-down to a face-up orientation such that the trailing edge becomes the leading edge, wherein the face-up orientation includes a region for address information to be printed thereon.

14. The method according to claim 12, wherein the rotatable cage assembly further comprises one or more belts for conveying the mail item while contained in the rotatable cage assembly.

15. The method according to claim 12, wherein the rotatable cage assembly has an upper and lower conveyance system and conveyance servo motor for mail item conveyance.

16. The method according to claim 12, wherein the variable motion profile factors in gap between adjacent mail items, geometry of cage assembly conveyance drive configuration, motion coupling between invert and conveyance motion profiles, and conveyance speeds of document processing equipment associated with the cage assembly.

17. The method according to claim 12, further comprising the step of:

after conveyance of the mail item is stopped within the cage assembly, accelerating the mail item with its trailing edge forward in the second direction towards input guide section.

18. The method according to claim 17, wherein the accelerating and decelerating steps are performed by way of one or more belts associated with the cage assembly.

19. The method according to claim 12, wherein the mail item is selected from an envelope, a document of one or more sheets, a booklet or insert.

20. The method according to claim 12, further comprising the step of receiving a second mail item into the cage assembly.

21. The method according to claim 12, wherein the axis of rotation of the rotatable cage assembly is perpendicular to the feeder path.

22. The method according to claim 12, further comprising the step of:

stopping rotation of the rotatable cage assembly following the inverting of the mail item such that the inverted mail item exits the rotatable cage assembly.

* * * * *